US008884723B2

(12) United States Patent
Yassini et al.

(10) Patent No.: US 8,884,723 B2
(45) Date of Patent: Nov. 11, 2014

(54) TE011 CAVITY FILTER ASSEMBLY

(75) Inventors: Bahram Yassini, Waterloo (CA); Ming Yu, Waterloo (CA)

(73) Assignee: Com Dev International Ltd., Cambridge (CA)

( * ) Notice: Subject to any disclaimer, the term of this patent is extended or adjusted under 35 U.S.C. 154(b) by 882 days.

(21) Appl. No.: 12/792,326

(22) Filed: Jun. 2, 2010

(65) Prior Publication Data

US 2011/0298566 A1 Dec. 8, 2011

(51) Int. Cl.
*H01P 1/208* (2006.01)
*H01P 7/06* (2006.01)

(52) U.S. Cl.
CPC . *H01P 7/06* (2013.01); *H01P 1/208* (2013.01)
USPC ..... 333/202; 333/227; 333/212

(58) Field of Classification Search
CPC ..... H01P 1/208; H01P 7/06
USPC ..... 333/202, 208, 212, 227, 228, 231–233
See application file for complete search history.

(56) References Cited

U.S. PATENT DOCUMENTS

| | | | | |
|---|---|---|---|---|
| 2,600,186 | A * | 6/1952 | Banos, Jr. | 333/228 |
| 2,713,153 | A * | 7/1955 | Kannenberg | 333/228 |
| 3,161,840 | A * | 12/1964 | Hoeck et al. | 333/233 |
| 4,156,860 | A | 5/1979 | Atia et al. | |
| 4,673,894 | A * | 6/1987 | Rogers | 331/96 |
| 5,614,877 | A | 3/1997 | Raghavan et al. | |
| 6,118,356 | A * | 9/2000 | Loi et al. | 333/209 |

FOREIGN PATENT DOCUMENTS

| | | |
|---|---|---|
| EP | 1429457 | 6/2004 |
| FR | 2512279 | 3/1983 |
| FR | 2811811 | 1/2002 |

OTHER PUBLICATIONS

Kreinheder D E et al: "Improved Selectivity in Cylindrical TE/sub011/Filters by TE/sub211/TE/sub311/Mode Control", Microwave Symposium Digest, 1982 IEEE MTT-S International, IEEE, Piscataway, NJ, U.S.A. Jun. 15, 1982, pp. 396-398.

Extended European Search Report dated Nov. 10, 2011 for Application No. 11157297.0-2220.

H. L. Thal Jr., "Cylindrical TE011/TM111 Mode Control by Cavity Shaping", IEEE Transactions on Microwave Theory and Techniques, vol. 27, No. 12, Dec. 1979, New York, pp. 982-986.

"General TE011-Mode Waveguide Bandpass Filters", Ali E. Atia and Albert E. Williams, IEEE Transactions on Micro-wave Theory and Techniques, vol. MTT-24, No. 10, Oct. 1976, p. 640.

(Continued)

*Primary Examiner* — Benny Lee
(74) *Attorney, Agent, or Firm* — Bereskin & Parr LLP; Isis Caulder

(57) ABSTRACT

A TE011 cavity filter assembly is disclosed. The system includes at least one resonator operating in TE011 mode having a resonant frequency. The at least one resonator may include a cavity comprising an inner diameter and a cavity length. The at least one resonator may also include a first metal disc inside the cavity. The first metal disc may include a disc diameter and a void in the metal disc, which includes a void diameter and a void depth. The inner diameter of the cavity may be greater than the disc diameter creating a gap with a gap width and a gap depth. The TE011 cavity filter assembly may further include positive coupling.

25 Claims, 17 Drawing Sheets

(56) References Cited

OTHER PUBLICATIONS

R.J. Cameron, H. G. Grecg, C. J. Radcliffe and Ju. D. Rhodes, "Extracted-pole Filter Manifold Multiplexing", IEEE Transactions on Microwave Theory and Techniques, vol. 30, No. 7, Jul. 1982, pp. 1041-1050.

G.L. Matthaei, L. Young, and E. M. T. Jones, Microwave Filters, Impedance-matching Networks and Coupling Structures, New York: McGraw-Hill 1964, pp. 921-934.

* cited by examiner

| | 602 | 604 |
|---|---|---|
| OPERATING FREQ (GHz) | ~20 | ~20 |
| CAVITY DIAMETER | 0.875 in | 0.875 in |
| CAVITY LENGTH | 0.519 in | 0.519 in |
| GAP DEPTH | 0.060 in | 0.060 in |
| GAP WIDTH | 0.020 in | 0.020 in |
| HALF WAVELENGTH | ~0.295 | ~0.295 |
| IRIS LENGTH | 0.200 in | 0.400 in |
| IRIS WIDTH | 0.150 in | 0.150 in |
| $f_{odd}$ (GHz) | 19.808 | 20.093 |
| $f_{even}$ (GHz) | 19.913 | 19.880 |
| COUPLING SIGN | NEGATIVE ($f_{odd} < f_{even}$) | POSITIVE ($f_{odd} > f_{even}$) |

FIG. 6C

| PARAMETER NAME | | VALUE (INCHES) |
|---|---|---|
| LONG IRIS LENGTH | LIL | 0.40 |
| LONG IRIS WIDTH | LIW | 0.05 |
| SHORT IRIS WIDTH | SIW | 0.05 |

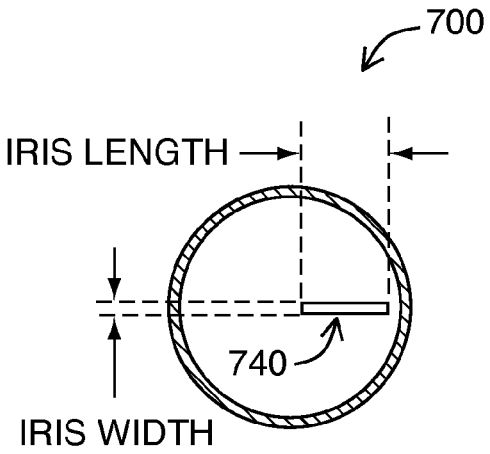
FIG. 7A
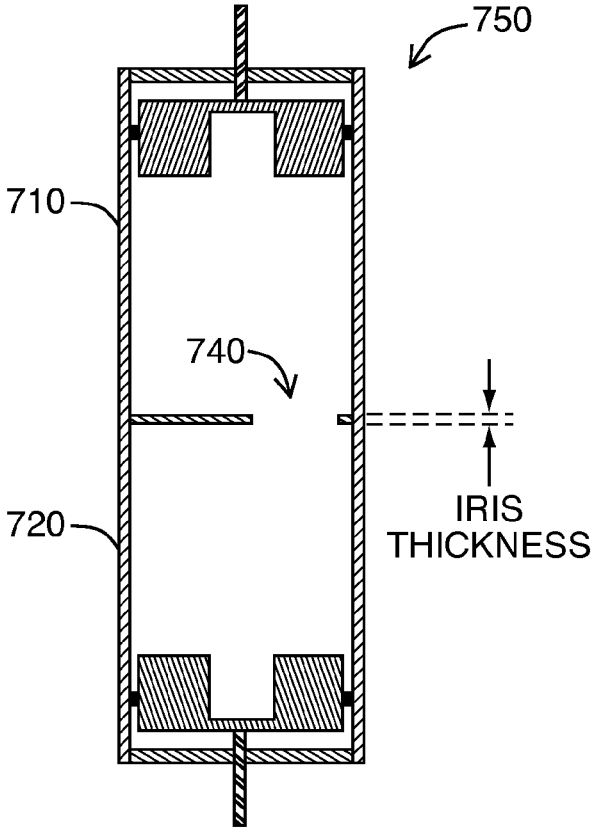
FIG. 7B
| | 702 | 704 |
|---|---|---|
| OPERATING FREQ (GHz) | ~20 | ~20 |
| CAVITY DIAMETER | 0.875 in | 0.875 in |
| CAVITY LENGTH | 0.519 in | 0.519 in |
| GAP DEPTH | 0.10 in | 0.10 in |
| GAP WIDTH | 0.020 in | 0.020 in |
| HALF WAVELENGTH | ~0.295 | ~0.295 |
| IRIS LENGTH | 0.240 in | 0.430 in |
| IRIS WIDTH | 0.050 in | 0.050 in |
| $f_{odd}$ (GHz) | 19.858 | 20.163 |
| $f_{even}$ (GHz) | 19.981 | 19.973 |
| COUPLING SIGN | NEGATIVE ($f_{odd} < f_{even}$) | POSITIVE ($f_{odd} > f_{even}$) |
FIG. 7C

TE011 CAVITY FILTER ASSEMBLY

FIELD

Embodiments described herein relate to assemblies and methods for creating a TE011 cavity filter assembly. More particularly, embodiments described herein relate to systems for creating a TE011 cavity filter assembly including a metal disc inside the cavity filter assembly and positive and negative coupling.

BACKGROUND

A microwave filter is an electromagnetic circuit that can be tuned to pass energy at a specified resonant frequency. Accordingly, microwave filters are commonly used in telecommunication applications to transmit energy in a desired band of frequencies (i.e. the passband) and reject energy at unwanted frequencies (i.e. the stopband) that are outside the desired band. In addition, the microwave filter should preferably meet some performance criteria for properties, which typically include insertion loss (i.e. the minimum loss in the passband), loss variation (i.e. the flatness of the insertion loss in the passband), rejection or isolation (the attenuation in the stopband), group delay (i.e. related to the phase characteristics of the filter) and return loss.

A TE011 cavity filter assembly operating in single mode is commonly used in low-loss filters. It has a high, unloaded quality factor that makes it very attractive for a wide range of applications, including high-power applications.

A filter assembly may be made up of one or more resonators. Each resonator may consist of a cavity, which has interior surfaces that reflect a wave of a specific frequency. As more wave energy enters the cavity, it combines with and reinforces the standing wave, increasing its intensity. Although resonators are designed to generate waves of specific standing wave patterns or resonant modes, alternative resonant modes may also be formed. These unwanted modes may be degenerate and cause unwanted degradation to the filter performance.

Cavity shaping is well known in the art to separate the degenerate modes from a resonator cavity operating in the desired TE011 mode. However, such shaping increases the footprint of the TE011 cavity filter assembly and increases manufacturing complexity. Similarly, certain coupling techniques require the resonators to be stacked, with two resonators connected end on end and offset from one another.

SUMMARY OF THE INVENTION

Embodiments described herein relate to systems and methods for creating a TE011 cavity filter assembly.

In one broad aspect, there is provided a TE011 cavity filter assembly. The assembly includes at least one resonator operating in the TE011 mode having a resonant frequency and a TM111 mode. The one resonator may include a cavity comprising an inner diameter, and a cavity length and a first metal disc inside the cavity. The first metal disc may include a disc diameter and a void in the metal disc, which includes a void diameter and a void depth. The inner diameter of the cavity may be greater than the disc diameter creating a gap with a gap width and a gap depth. The void diameter and the void depth of the void splits the TM111 mode from the operating TE011 mode and shifts the TM111 mode to a lower frequency than the TE011 mode resonant frequency.

In another feature of that aspect, the one resonator operating in the TE011 mode has a TM111 mode and a TE311 mode, and the void diameter and void depth of the void may split the TM111 mode from the operating TE011 mode. In addition, the gap width and the gap depth of the gap may shift the TE311 mode and splits the TM111 mode from the operating TE011 mode.

In another feature of that aspect, the gap depth of the gap may be less than a quarter of the free space wavelength of the resonant frequency.

In another feature of that aspect, the at least one resonator may be tunable and may include a tuning mechanism to adjust the cavity length of the at least one resonator and an enclosure contact to maintain electrical contact between the cavity and the first metal disc inside the cavity.

In another feature of that aspect, the cavity resonator includes a second metal disc inside the cavity at the opposing end to the first metal disc. The second metal disc may include a second disc diameter and a second void in the second metal disc, which may include a second void diameter and a second void depth. The inner diameter of the cavity may be greater than the second disc diameter creating a second gap with a second gap width and a second gap depth. In some embodiments, one of the two discs inside the cavity may be fixed to the inside of the cavity.

In another feature of that aspect, the TE011 cavity filter assembly includes at least one iris for coupling two resonators. The iris may include an aperture having a width, a thickness, and a length coupling the two resonators. In some embodiments, the iris may be a long iris. The length of the long iris is greater than half of the free space wavelength of the resonant frequency, and the cavity lengths of the two resonators may be greater than the length of the long iris. Further, the TE011 cavity filter assembly may include at least one short iris, wherein the length of the short iris is less than half of the free space wavelength of the resonant frequency. In some embodiments, the at least one long iris and the at least one short iris may couple the same two resonators. In other embodiments, the two cavities may be stacked with no cavity offset and share a common cavity end wall.

In a further feature, the TE011 cavity filter assembly includes cross coupling the resonator operating in TE011 mode. The cross coupling may include at least three irises connecting to the at least one resonator. Because the resonator has a TM111 mode and a TE311 mode, the geometry of the at least three irises connecting to the at least one resonator may suppress the TM111 mode and the TE311 mode. The TE011 cavity filter assembly may include an input iris and an output iris, where one of the three cross coupling irises connecting to the resonator includes either the input iris or the output iris and connects to an outside waveguide line. The TE011 cavity filter assembly may also include at least one single layer tri-section, wherein the single layer tri-section includes three resonators in a single layer. Further, the single layer tri-section may be tunable. It may include a tuning mechanism to adjust the cavity length of the three resonators of the single layer tri-section. Each single layer tri-section may also add one transmission zero to the high frequency side of the passband. In addition, the TE011 cavity filter assembly may include many single layer tri-sections coupled together.

In another broad aspect, there is a method for coupling two resonator cavities having a resonant frequency in a TE011 cavity filter assembly. The method includes providing two resonator cavities. The cavities may have cavity lengths greater than half of the free space wavelength of the resonant frequency. A long iris may couple the two resonator cavities. The long iris is an aperture having a width, a thickness, and a length, where the length of the long iris may be greater than half of the free space wavelength of the resonant frequency.

The cavity lengths of the two resonator cavities may be greater than the length of the long iris. The two coupled resonator cavities may also have two resonance modes having an odd mode frequency greater than an even mode frequency. The long iris may further provide positive coupling, wherein positive coupling includes a coupling sign that is opposite to a short iris and wherein the short iris is an aperture having a width, a thickness, and a length, coupling the two resonator cavities, wherein the length of the short iris is less than half of the free space wavelength of the resonant frequency.

In another feature of that aspect, the long iris may provide low sensitivity to cavity length variation.

In another feature of that aspect, the method may include coupling the two resonator cavities using a short iris. The short iris is an aperture having a width, a thickness, and a length, coupling the two resonator cavities, wherein the length of the short iris is less than half of the free space wavelength of the resonant frequency, and wherein the two coupled resonator cavities comprise two resonance modes having an odd mode frequency less than an even mode frequency.

In another feature of that aspect, the two resonator cavities may consist of two adjacent resonator cavities.

In another feature of that aspect, the two resonator cavities may consist of two stacked resonator cavities having no cavity offset and sharing a common cavity end wall, wherein the long iris couples the two stacked resonator cavities through the common cavity end wall.

BRIEF DESCRIPTION OF THE DRAWINGS

For a better understanding of embodiments of the systems and methods described herein, and to show more clearly how they may be carried into effect, reference will be made, by way of example, to the accompanying drawings in which:

FIG. 6C is a table highlighting the operation of the two coupled resonators in FIG. 6A and FIG. 6B with different iris lengths;

FIG. 7A is a top view schematic diagram of two stacked resonators coupled together with no cavity offset;

FIG. 7B is a side view schematic diagram of the two stacked resonators in FIG. 7A;

FIG. 7C is a table highlighting the operation of the two coupled resonators in FIG. 7A with different iris lengths;

Figure 1:
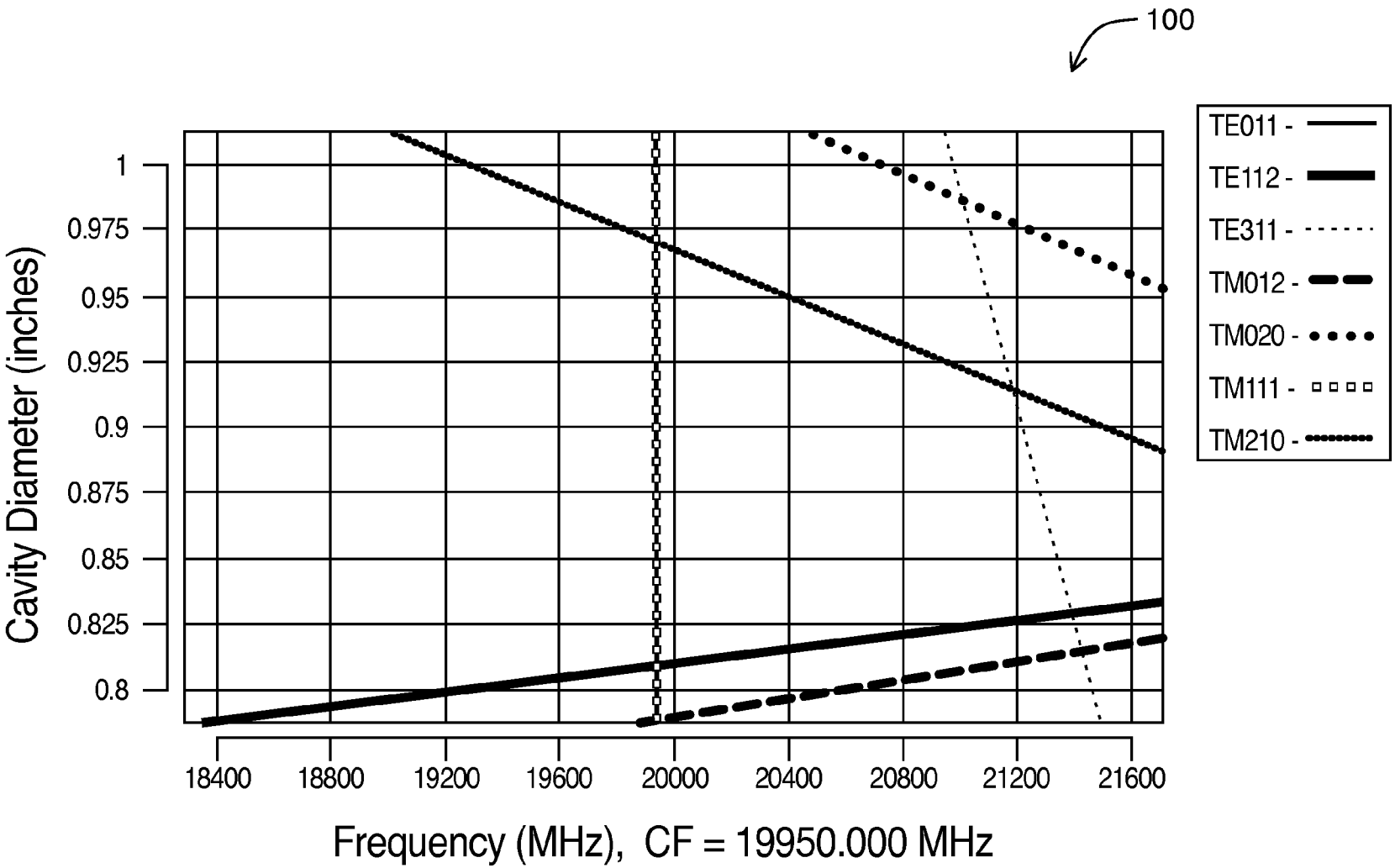
FIG. 1 is a graph depicting the common modes present in a TE011 cavity resonator operating at 19.95 GHz.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

Microwave TE011 single mode cavity filters have been around for many years. TE011 mode operation offers a very high quality factor that makes them attractive for a number of applications, including low loss and high power filters. Additionally, a TE011 mode cavity resonator is frequently used for its clean and spurious-free operation over a wide frequency range. Furthermore, it has been recognized that the electric field pattern and current distribution displayed by TE011 filters allow for easy tuning.

However, the TE011 cylindrical cavity mode is degenerate with a pair of resonant TM111 modes, which must be addressed within the TE011 cavity filter assembly design in order to make the TE011 mode appropriate for many sensitive applications. As known in the art, any cavity designed to support TE011 resonance will also be capable of supporting TM111 resonance(s). This degeneracy may lead to undesired performance. Thus, to improve the performance of the TE011 resonator and to incorporate it into sensitive applications, the degenerate TM111 resonance(s) must be split from the operating TE011 mode in order to make the TE011 mode usable across a wide frequency band.

Reference is now made to FIG. 1, which provides an exemplary graph 100 illustrating the performance of an exemplary resonator designed to operate in TE011 mode with a center frequency of 19.95 GHz (illustrated in FIG. 1 as "CF=19950.000 MHz"). The graph 100 illustrates the relationship of different resonant modes with respect to frequency (x-axis, MHz) and cavity diameter (y-axis, inches). The graph 100 highlights a number of different resonant modes that exist in a resonator operating in TE011 mode and that may affect the performance of a cavity filter assembly. Referring to the graph 100, the closest modes for a cavity with a diameter of 0.875 inches include the TM111 mode(s) and the TE311 mode. In fact, as the TM111 overlap across a range of possible cavity diameters. Other modes, such as the TE112 mode, the TM012 mode, the TM020 mode, and the TM210 mode may be present, but may affect the performance of the dominant TE011 resonant mode to a lesser extent. The affect of these additional spurious modes on the performance of the operating TE011 mode may be disregarded for many applications where the modes will not contaminate the spurious-free window.

To improve the performance of the operating TE011 mode, changes can be made inside a resonator cavity to split the degenerate TM111 mode(s) from the TE011 mode and shift these unwanted modes away from the TE011 mode to create a wider spurious-free window. Specifically, the inventors have recognized that the TM111 mode is very strong at the corner and at the center of a cavity resonator. Accordingly, a metal disc with a central void at one or both ends of the cavity resonator will split the TM111 mode from the operating TE011 mode and may shift its resonant frequency to a lower frequency. Similarly, the TE311 mode is strong at the corners of the cavity. However, it is weak at the center of the resonator. Accordingly, it has been discovered that a gap at the corners of a cavity resonator will shift the spurious TE311 mode to lower frequencies, while the introduction of a central void in the metal disc placed at one or both ends will have minimal affect.

The inventors have discovered that a gap at the corner of a resonator will shift both the TE311 resonant frequency and the TM111 resonant frequency. If properly designed, such shifts may improve the isolation of the operating TE011 mode, resulting in better performance and a larger spurious-free window. Adding a void to one or both ends of the resonator may also improve performance by splitting the degenerate TM111 mode from the operating TE011 mode. As the TE011 mode field is weak at both the center and at the corners of a resonator cavity, the insertion of a metal disc into either end of the resonator may have minimal effect on the TE011 mode operation if the dimensions of the disc(s) are properly considered.

Figure 2:
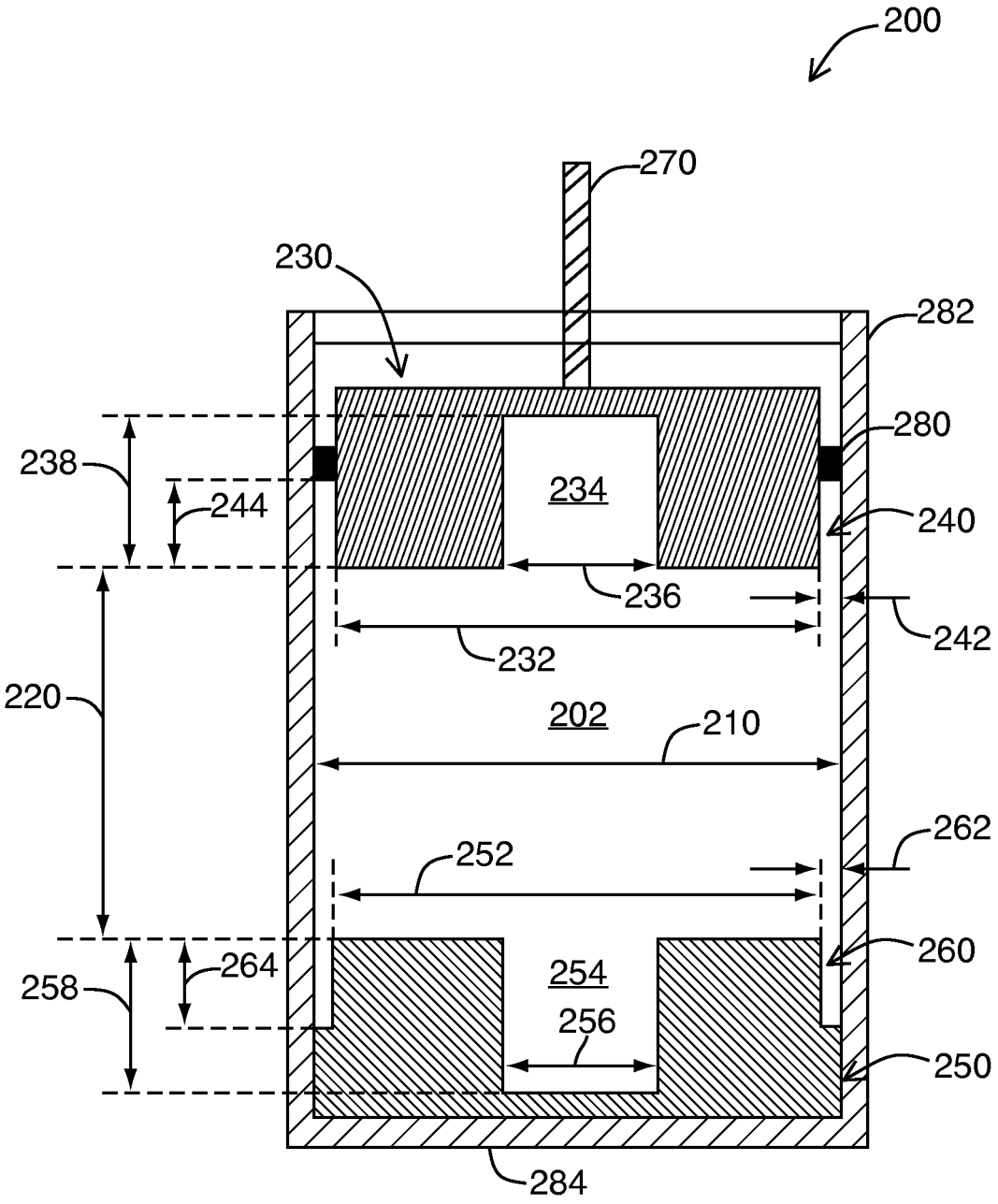
FIG. 2 is a cross sectional diagram of an exemplary resonator utilized in a TE011 cavity filter assembly according to one embodiment.

Reference is now made to FIG. 2, which shows a cross section for a component resonator 200 according to some embodiments. This resonator 200 may form part of an exemplary TE011 cavity filter assembly 900, 1000, 1050, 1100 seen in FIG. 9A, FIG. 10A, FIG. 10B, and FIG. 11, respectively. The resonator 200 includes a cavity 202 having an inner diameter 210 and a cavity length 220. Inside the cavity 202 is a first metal disc 230 placed at one end. Although depicted as flat, the surface of the disc 230 may be non-planar. Such a depiction should not be construed as limiting as other surface shapes may be possible. For example, the surface of the disc may be concave up, concave down i.e., convex) and the like.

The first metal disc 230 has a disc diameter 232. It may include a void 234 in the first metal disc 230 having a void diameter 236 and a void depth 238. The void 234 in the first metal disc 230 may be cylindrical. However, any appropriate shape may be used. A non-cylindrical void 234, for example, may have an ovular cross-section, may be asymmetric, or may not be uniform through the entire void depth 238. Similarly, the void 234 may be coaxial with the cavity 202 and the first metal disc 230 or, in some embodiments, may be off-center. Furthermore, a dielectric (not shown) may be included inside the void 234 to improve performance.

The disc diameter 232 is less than the inner diameter 210 of the cavity 202. This difference creates a gap 240 between the first metal disc 230 and the cavity wall 282. This gap 240 may include a gap width 242 and a gap depth 244. In some embodiments, the gap width 242 and/or the gap depth 244 may be uniform. In other embodiments, the gap width 242 and/or the gap depth 244 may include non-uniformities. The gap depth 244 may be measured from the surface of the first metal disc 230 facing the inside of the cavity 202 and an enclosure contact 280. The enclosure contact 280 is used to maintain electrical contact between the first metal disc 230 and the cavity wall 282. As seen in FIG. 2, the gap depth 244 may be either less than or greater than the void depth 238. Furthermore, a dielectric (not shown) may also be included inside the gap 240 to improve performance.

The gap width 242 and the gap depth 244 shift the resonant frequency of the TE311 mode and TM111 mode downward to lower frequencies. The thickness (i.e., gap depth 244) of the metal disc 230 must be considered in the design of the resonator 200 and TE011 cavity filter assembly as a metal disc 230 with undue thickness can introduce unwanted resonant frequencies. Even though the metal disc 230 is in electrical contact with the cavity wall, when the gap depth 244 approaches a resonant length (i.e., a quarter of the free space wavelength), the metal disc 230 may add unwanted resonance into the performance of the resonator 200. It is therefore important to keep the gap depth 244 of the metal disc 230 shorter than a quarter of the free space wavelength of the resonant frequency of the resonator 200 to avoid this unwanted degradation of filter performance.

The resonator 200, as part of the TE011 cavity filter assembly, may also include a second metal disc 250, where the first and second metal discs 230, 250 are placed at opposing ends of the cavity 202. The second metal disc 250 may have a second void 254, having a second void diameter 256 and a second void depth 258. Similarly, the second disc diameter 252 may be less than the inner diameter 210 of the cavity 202. This creates a second gap 260 between the second metal disc 250 and the cavity wall 282. The second gap 260 may include a second gap width 262 and a second gap depth 264. In some embodiments, if the first or second metal disc 230, 250 is fixed to the inside of the cavity 202 as shown in FIG. 2 with the second metal disc 250, the metal discs 230, 250 may define the bottom of the gap 260. A cutaway in the metal discs 230, 250 may provide the gap 240, 260 between the cavity wall 282 and the metal discs 230, 250. As in the first metal disc, the gap depth 264 may be either less than or greater than the void depth 258 and should be less than a quarter of the free space wavelength to minimize unwanted resonant frequencies, as described above. Furthermore, the first metal disc 230 and/or the second metal disc 250 may include void diameters 236, 256 that may be negligent or effectively zero. Such a metal disc 230, 250 without a void 234, 254 may be easier to manufacture. In other embodiments, the void diameters 236, 256 may be non-zero.

In some embodiments, the resonator 200, as part of the cavity filter assembly, is tunable. The length of the cavity 220 affects the resonant frequency of the resonator 200 operating in TE011 mode. The filter assembly may therefore include a tuning mechanism 270 that can be used to adjust the cavity length 220. This tuning mechanism 270 may include a plunger (or any appropriate mechanism) that moves the first metal disc 230 within the cavity 202. Since the length 220 of the cavity 202 is measured from the inner surface of each of the metal discs 230, 250, a tuning mechanism 270 may change the cavity length by changing the distance between the first metal disc 230 and either the second metal disc 250 or the opposing end wall 284. In other words, if there is only a first metal disc 230, the cavity length 220 is measured from the inner surface of the first metal disc 230 to the opposing end wall 284.

As mentioned, tuning the resonator 200 may also include an enclosure contact 280 to maintain electrical contact between the cavity wall 282 and the first metal disc 230 or the second metal disc 250 (not shown for second metal disc 250). As seen with respect to the first metal disc 230, the enclosure contact 280 may define the bottom of the gap 240 and the gap depth 244. The enclosure contact 280 may be coupled to either the cavity or to the first metal disc 230 and/or the second metal disc 250 (not shown for second metal disc 250). The enclosure contact 280 may be a solid ring surrounding the first metal disc 230 and/or the second metal disc 250 (not shown for second metal disc 250) or made of individual pieces (not shown) placed appropriately around the first metal disc 230 and/or the second metal disc 250. The first metal disc 230 and/or the second metal disc 250 is then able to slide within the cavity 202 of the resonator 200 while maintaining electrical contact.

The enclosure contact 280 may be made of metal and provide electrical contact between the metal disc 230, 250 and the cavity wall 282. However, pure electrical contact between the cavity wall 282 and the first metal disc 230 through the enclosure contact 280 may not be required as long as the contact between the metal disc 230, 250 and the cavity wall 282 minimizes the surface impedance across any gap. This ensures that the impedance across the enclosure contact 280 does not lead to electric field or spurious-free window degradation. Unwanted surface impedance may lead to an undesirable shift in the TE311 mode and the TM111 mode. Furthermore, it may also create additional, undesirable modes.

In some embodiments, an enclosure contact 280 may not be necessary, as long as the surface impedance condition is met. However, utilizing an enclosure contact 280 eliminates any uncertainty in the modal operation and electric field distribution.

Reference is now made to FIG. 3A to FIG. 3D, which respectively show isometric drawings of four exemplary metal disc configurations for a resonator 320, 340, 360, 380, with one or two metal discs 330, 350 (FIGS. 3B, 3D) located within the cavity. Although shown as fixed, the first metal disc 330 and/or the second metal disc 350 may be tunable within the resonators 320, 340, 360, 380 using tuning mechanisms as described above in FIG. 2. Any of the four variations 320, 340, 360, 380 may be used within the TE011 cavity filter assemblies further described below.

Figure 3A:
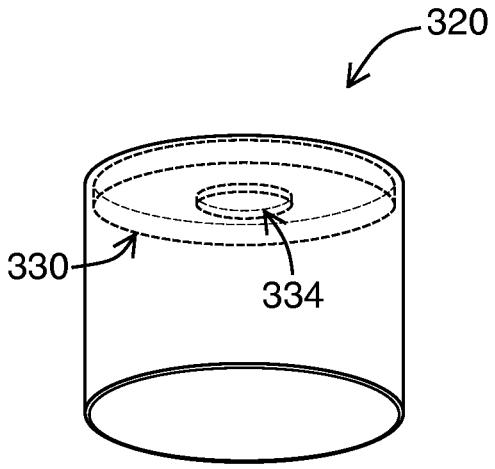
FIG. 3A is an isometric drawing of an exemplary resonator utilizing a single metal disc.

Referring now to FIG. 3A, a diagram of a resonator 320 is shown with a single first metal disc 330 located within the cavity. The first metal disc 330 may include features as described above in relation to FIG. 2. The first metal disc 330 may include a void 334 and a gap (not labeled). The dimensions of the first metal disc 330 inside the cavity may be appropriate to the resonator 320, as described above in relation to FIG. 2. For example, the gap depth (not labeled) may be less than a quarter of the free space wavelength of the operating TE011 mode.

Figure 3B:
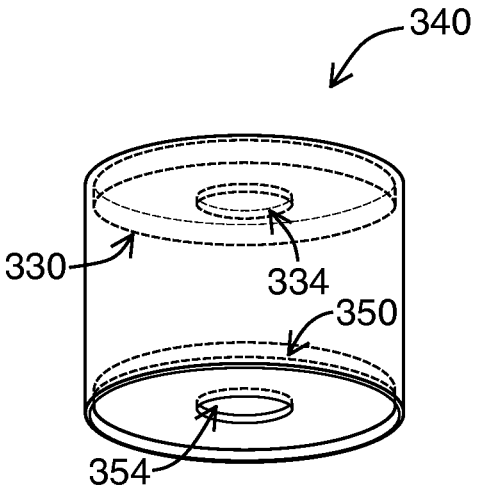
FIG. 3B is an isometric drawing of an exemplary resonator utilizing two metal discs.

Referring now to FIG. 3B, a diagram of a resonator 340 is shown with a first metal disc 330 and a second metal disc 350 located within the cavity, as described in FIG. 2. The resonator 340 may include a void 334 in the first metal disc 330 and a second void 354 in the second metal disc 350. As in FIG. 3A, the dimensions of the first metal disc 330 and the second metal disc 350 inside the cavity may be appropriate to the resonator 340. Furthermore, the first metal disc 330 and the second metal disc 350 may create two gaps (not labeled) inside the cavity at opposing ends of the resonator 340.

Figure 3C:
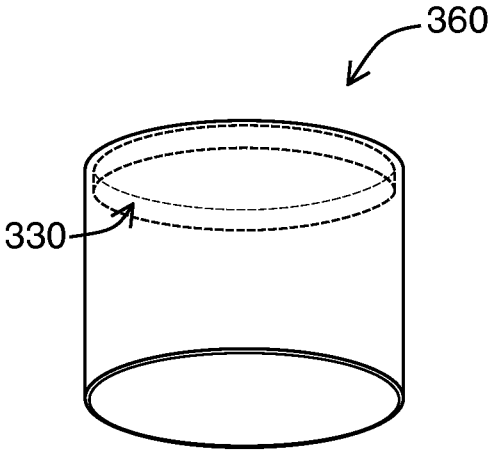
FIG. 3C is an isometric drawing of an exemplary resonator utilizing a single metal disc with a negligent void diameter.

FIG. 3C is a diagram of a resonator 360 with a single first metal disc 330 located within the cavity. The first metal disc 330 may include features as described above in relation to FIG, 2. In some embodiments, the first metal disc 330 may lack a void, as described above.

Figure 3D:
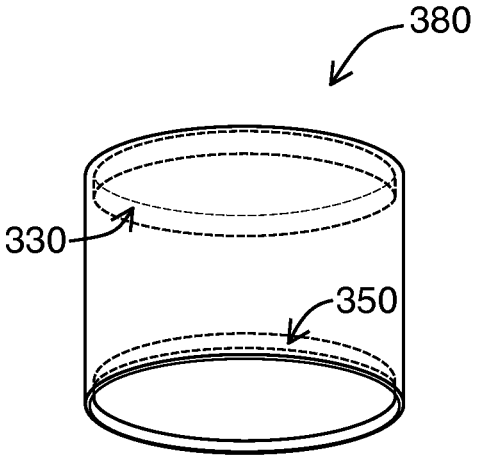
FIG. 3D is an isometric drawing of an exemplary resonator utilizing two metal discs with negligent void diameters.

Finally, FIG. 3D is a diagram of a resonator 380 with a first metal disc 330 and a second metal disc 350 located within the cavity. The first metal disc 330 may include features as described above in relation to FIG. 2. The second metal disc 350 may include features as described above in relation to FIG. 2. In some embodiments, the first metal disc 330 and the second metal disc 350 may each lack a void.

Referring back to FIG. 2, the voids 234, 254 in the first and second metal discs 230, 250 improve the performance of an exemplary resonator 200. As discussed, the TE011 mode of the cylindrical resonator 200 is weak near the corners of the cavity 202 and near the center of each of the ends. Accordingly, unlike the TM111 mode and the TE311 mode, the operating TE011 mode is not strongly affected by either the gaps 240, 260 or the voids 234, 254 created in the cavity 202 by the first metal disc 230 and the second metal disc 250.

The degenerate TM111 mode(s) and the spurious TE311 mode react differently to dimension changes in the gaps 240, 260 and the voids 234, 254. While the electric field of the TE311 mode is strong at the corners of the cavity 202, it is relatively weak near the center of each of the ends. The electric field of the TM111 mode, on the other hand, is strong at both the corners and the center of each of the ends of the cavity 202. Such differences between the two modes are important to recognize, as a balance may need to be struck to optimize the improved spurious-free window.

Figure 4A:
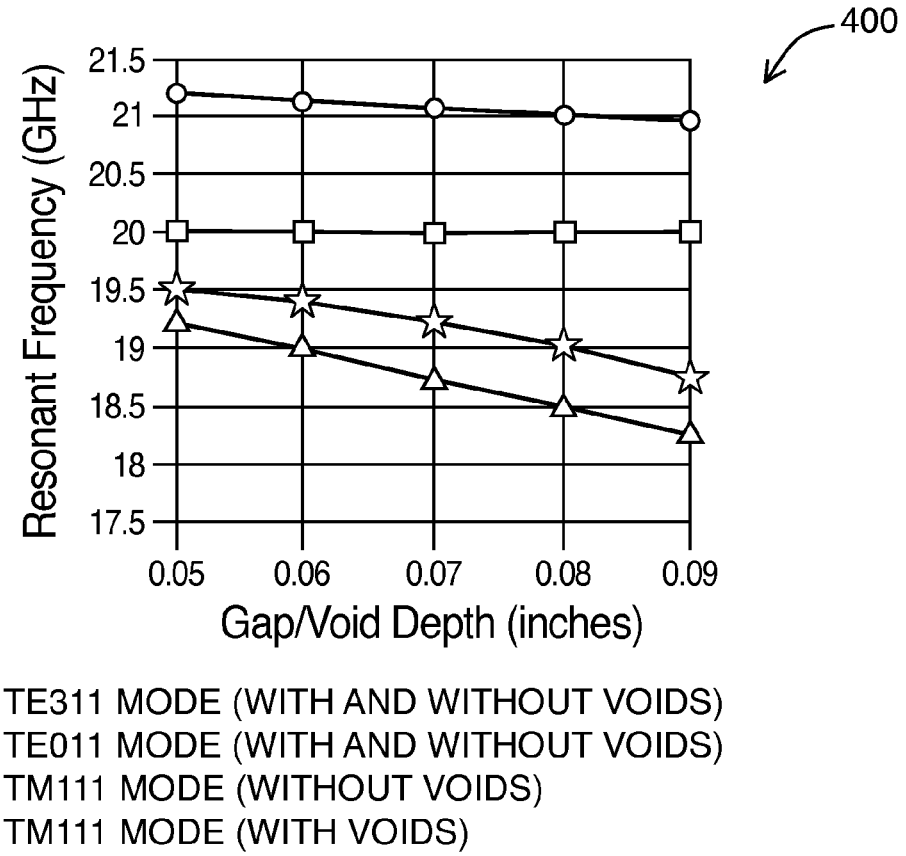
FIG. 4A is a graph depicting the resonant performance of the two exemplary resonator designs depicted in FIG. 3B and FIG. 3D.
Figure 4B:
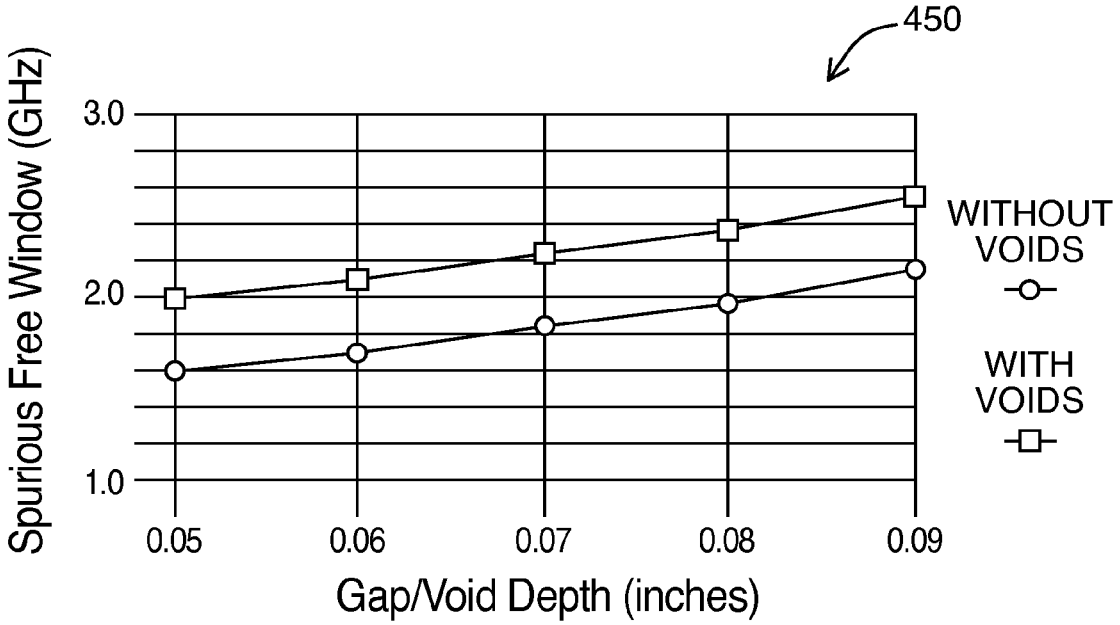
FIG. 4B is a graph depicting the spurious-free performance of the two exemplary resonator designs depicted in FIG. 3B and FIG. 3D.

Reference is now made to FIG. 4A and FIG. 4B, which demonstrate the relative change to the response of the TE011 mode, the degenerate TM111 mode and the spurious TE311 mode of two exemplary resonators, in relation to changes in the two metal discs located within the two exemplary resonator configurations. Referring to the structural features of the resonator 200 described in FIG. 2, the two configurations have different metal discs positioned within their respective cavities. The first configuration includes two metal discs 230, 250 that do not utilize the voids 234, 254, such as shown in FIG. 3D for isolating the TM111 mode from the operating TE011 mode. The second configuration includes the voids 234, 254 within its two metal discs 230, 250, such as shown in FIG. 3B. In both configurations, each disc 230, 250 may define a gap 240, 260 for shifting both the TM111 mode and the TE311 mode. Other structural features, as described in FIG. 2, are otherwise similar for both resonator configurations.

In both FIG. 4A and FIG. 4B, the dimension of the gap widths 242, 262 for both configurations remains constant, while the gap depths 244, 264 for both configurations will vary (illustrated as Gap/Void Depth (inches) on the x-axis of FIG. 4A and FIG, 4B respectively). Additionally, in the second configuration (e.g., FIG. 3B) that includes the voids 234, 254 in the two metal discs 230, 250, the void diameters 236, 256 remain constant and the void depths 238, 258 will vary. Furthermore, the second configuration has matching gap depths 244, 264 and void depths 238, 258 and the two depths (gap and void) will vary by a matching amount.

Referring now to FIG. 4A with reference to the resonator 200 in FIG. 2, the graph 400 illustrates the resonant frequency (shown in FIG. 4A as "Resonant Frequency (GHz)" on the y-axis) of the three electromagnetic field modes (i.e., TE011 mode, TM111 mode(s), TE311 mode) with respect to variations in the matching gap depths 244, 264 and void depths 238, 258 (for the second configuration (i.e., FIG. 3B) where voids 234, 254 are included).

As can be seen in FIG. 4A, the resonant frequency of the TE011 mode for both configurations (with and without voids and shown in FIG. 4A as "TE011 MODE (WITH AND WITHOUT VOIDS)") is constant at approximately 20 GHz and is almost completely independent of the variations in gap depths 244, 264 and void depths 238, 258. Such a response is expected, as the TE011 mode is weak at both the corner and near the center of the cavity 202 and therefore unaffected by changes to either dimension.

Similarly, the TE311 mode displays identical resonant frequencies for the two configurations with and without the voids 234, 254 (shown in FIG. 4A as "TE311 MODE (WITH AND WITHOUT VOIDS)", as the TE311 mode is weak in the center and thus relatively unaffected by the addition of the voids 234, 254. However, as seen in the graph 400, the TE311 mode is strong at the corners of the cavity 202 and therefore the resonant frequency of the TE311 mode shifts with respect to the changing gap depths 244, 264.

As seen in FIG. 4A, the addition of voids 234, 254 may affect the resonant frequencies of the degenerate TM111 mode(s) (shown in FIG. 4A as "TM111 MODE (WITHOUT VOIDS)" and "TM111 MODE (WITH VOIDS)"). The resonant frequencies for the second configuration (i.e., FIG. 3B) including the voids 234, 254 in the metal discs 230, 250 shows a large shift from the resonant frequencies in the first configuration (i.e., FIG. 3D) where there are no voids 234, 254. As seen in the exemplary graph 400 of FIG. 4A, the addition of the voids 234, 254 splits the degenerate TM111 mode from the operating TE011 mode and further shifts the resonant frequencies downward. At void depths 238, 258 and/or gap depths 244, 264 of 0.05 inches a 0.4 GHz difference is seen between the two configurations (with voids, i.e., FIG. 3B, and without voids, i.e., FIG. 3D). When the void depths 238, 258 and/or gap depths 244, 264 are all increased to 0.08 inches or 0.09 inches, a 0.5 GHz shift downward in the TM111 resonant frequency is seen between the two configurations.

Referring to the graph 400 in FIG. 4A, it is apparent that the addition of the voids 234, 254 improves the downward shift of the TM111 mode and further splits it from the desired TE011 mode. Similarly, the graph 400 shows that the voids 234, 254 have little to no affect on the TE311 mode or the operating TE011 mode. It may also be seen that there must be a balance in increasing the void depths 238, 258 and/or gap depths 244, 264, arbitrarily. While increasing the dimensions of the gaps 240, 260 and voids 234, 254 shift the TM111 mode(s) further and away from the operating TE011 mode, the spurious TE311 mode also shifts downward, but in this instance, closer to the operating TE011 mode. Accordingly, a balance may need to be struck in choosing the gap depth(s) 244, 264 and void depth(s) 238, 258 to provide the widest spurious-free window that is centered about the resonant frequency of the operating TE011 mode. Simulations using a full wave solver may be useful in determining this balance.

Reference is now made to FIG. 4B, which illustrates the magnitude of the spurious-free window (in GHz and shown in FIG. 4B as "Spurious Free Window (GHz)") for the two resonator configurations tested in FIG. 4A. The spurious-free window is measured as the difference between the resonant frequencies of the TE311 mode and the TM111 mode. As can be seen in the graph 450, the greatest spurious-free window is measured where the matching gap depths 244, 264 and void depths 238, 258 are 0.09 inches. At this configuration, the spurious-free window for the relevant modes is greater than 2 GHz, for both configurations (i.e., with and without the voids 234, 254).

FIG. 4A and FIG. 4B are used to illustrate the general trends in the performance of the different electric field modes for the resonator 200 seen in FIG. 2 in relation to variances in matching gap depths 244, 264 and void depths 238, 258. It should be apparent that a number of discrete variables might affect the performance of the two configurations. Persons skilled in the art may also recognize that additional relationships may exist between the gap widths 242, 262, gap depths 244, 264, void diameters 236, 256, and void depths 238, 258, and the like than those explored above. The embodiments provided in FIG. 4A and FIG. 4B should not be construed as limiting as independent variations of each of the gap depths 244, 264 and each of the void depths 238, 258 is possible. In some embodiments, each of the dimensions for either the first metal disc 230 or the second metal disc 250 may be determined separately to fit different design parameters of the TE011 microwave cavity assembly.

As described above and illustrated in FIG. 2, the resonator 200 of a TE011 cavity filter assembly may include a first metal disc 230 and/or a second metal disc 250 inside the resonator cavity 202. The insertions of the metal discs 230, 250 may improve the performance of the TE011 cavity filter assembly by isolating and suppressing the degenerate and spurious modes. The gaps 240, 260, including the gap widths 242, 264 and gap depths 244, 264, shift both the TM111 mode and the TE311 mode downward towards lower frequencies. The inclusion of the voids 234, 254 may further split the TM111 mode from the operating TE011 mode.

The TE011 cavity filter assembly may further include irises coupling one or more resonators to each other. An iris is an aperture having a width, a thickness and a length coupling two resonators. The descriptors of an iris (i.e., width, thickness, and length) are described in relation to different cavity configurations will be further explained below in FIG. 6A and FIG. 7A.

The use of irises within cavity filter assemblies is a common practice to create electrical and magnetic coupling between resonators in a TE011 cavity filter design. However, persons skilled in the art typically use irises with a length of lower than half of the free space wavelength of the resonant frequency. These "short irises" provide a negative coupling value. A design for a new form of positive coupling is now described herein.

Figure 5A:
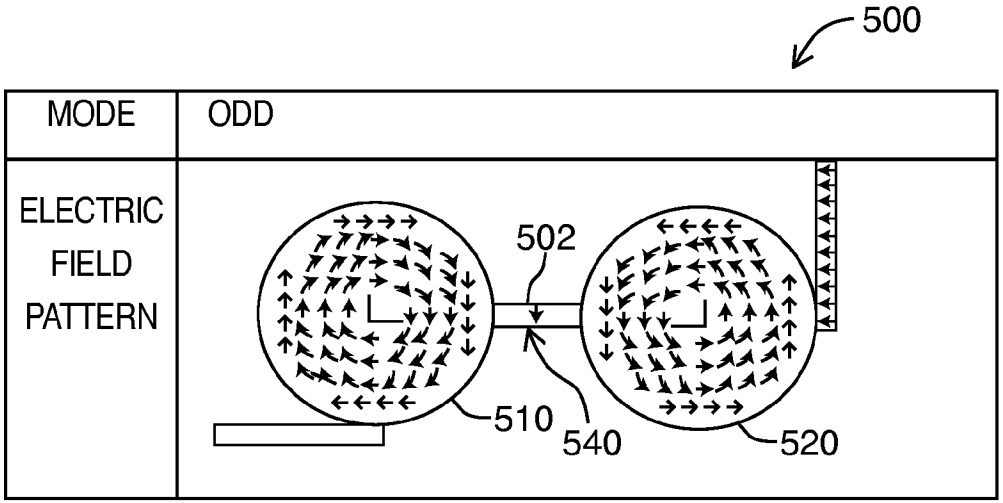
FIG. 5A is a schematic diagram illustrating the odd mode electric field pattern for two cavity resonators coupled together.
Figure 5B:
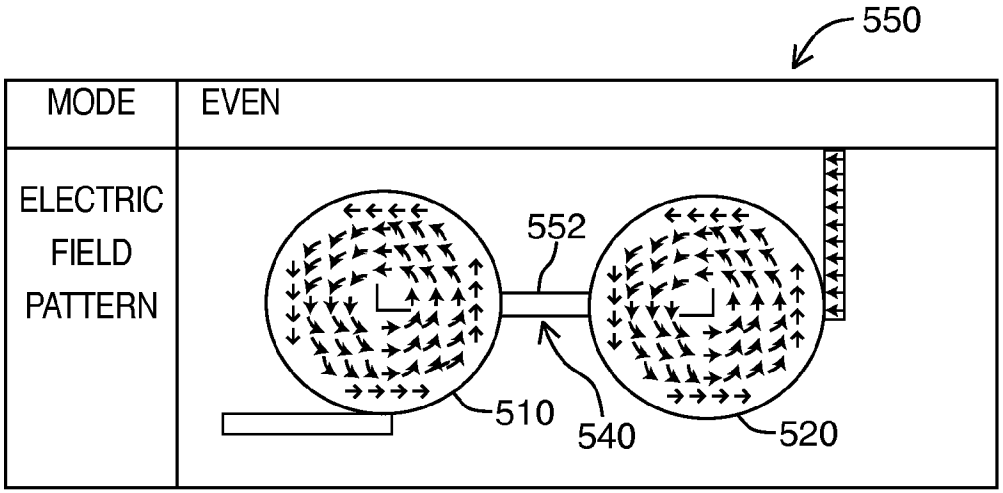
FIG. 5B is a schematic diagram illustrating the even mode electric field pattern for two cavity resonators coupled together.

Reference is now made to FIG. 5A and FIG. 5B, which respectively illustrate the electric field patterns 500, 550 for the two resonant modes of operation for a pair of coupled side-by-side resonators 510, 520. The two modes are described by their respective electric field patterns 500, 550. Each mode coexists independently and, for a pair of coupled resonators as configured in FIG. 5A and FIG. 5B, may be interpreted as an electric field pattern inside each resonator 510, 520. The electric field pattern in a cylindrical resonator 510, 520 operating in TE011 mode may follow a circular pattern (i.e., either clockwise or counter-clockwise). The response of the two resonance modes, and specifically, the different combinations of electric field patterns, may be useful to describe a form of coupling that may be used to design TE011 cavity filter assemblies.

Referring to the diagram 500 in FIG. 5A, the resonance mode is described as odd when the electric field patterns in the two resonators 510, 520 flow in opposite directions and interfere constructively in the iris 540. When the resonance mode is odd, there is electrical coupling since the electric field 502 in the iris 540 has a non-zero value.

Referring to the diagram 550 in FIG. 5B, the resonance mode is described as even when the electric field patterns in the two resonators 510, 520 flow in the same direction and interfere destructively (i.e. cancel) in the iris 540. When the resonance mode is even, there is magnetic coupling since the electric field 552 in the iris 540 vanishes.

The applicants have discovered that there is a correlation between the even mode and the odd mode frequencies and the length of the iris 540 coupling the two resonators 510, 520. Traditionally, coupling has utilized irises 540, where the length of the iris has been shorter than half of the free space wavelength of the operating TE011 mode, herein called short irises. It has been discovered that short irises may have a resonant frequency for the odd mode that is less than the resonant frequency for the even mode.

Conversely, where the length of the iris 540 is greater than half of the free space wavelength of the operating TE011 mode at resonant frequency, it has been found that the odd mode resonant frequency may be greater than the even mode resonant frequency. Irises 540 with a length greater than half of the free space wavelength of the operating TE011 mode are herein called long irises. Furthermore, as the coupling provided by the short iris is herein called negative coupling, the coupling provided by the long iris is herein called positive coupling, which is opposite in sign to that of the short iris.

One characteristic of a long iris coupling two resonators operating in TE011 mode is its low sensitivity to cavity length variation. The sensitivity is low when the iris length is much greater than half of the free space wavelength and when the iris length is close to the cavity length. These features make long irises desirable for applications that require stable coupling over a wide range of cavity lengths, such as tunable filters and the like.

Figure 6A:
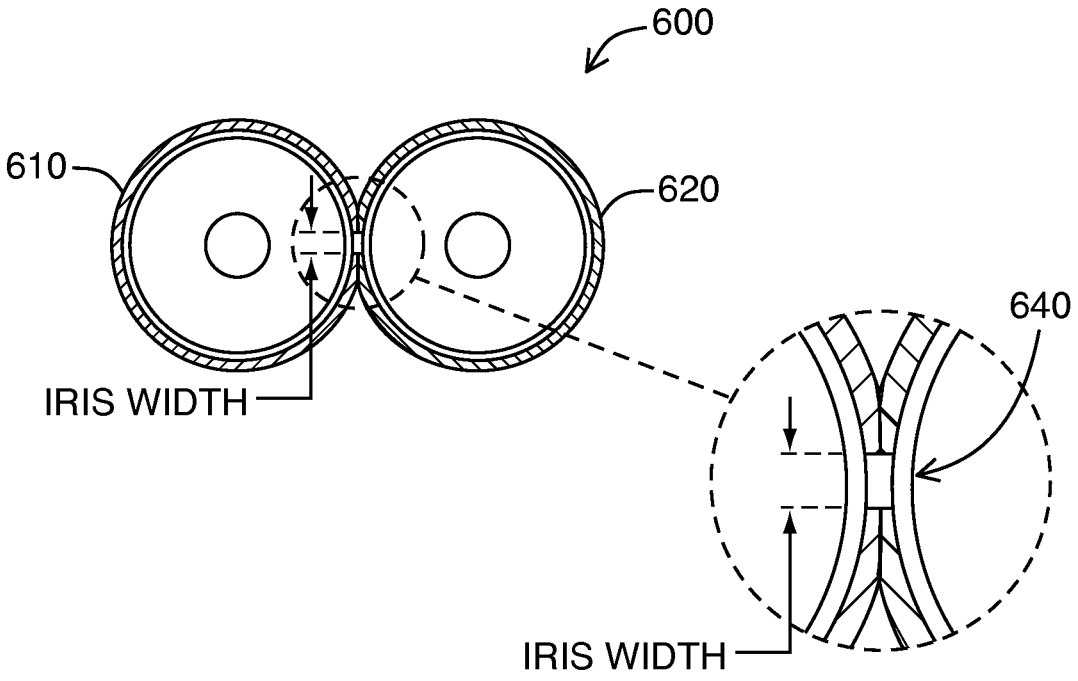
FIG. 6A is a top view schematic diagram of two side-by-side resonators coupled together.
Figure 6B:
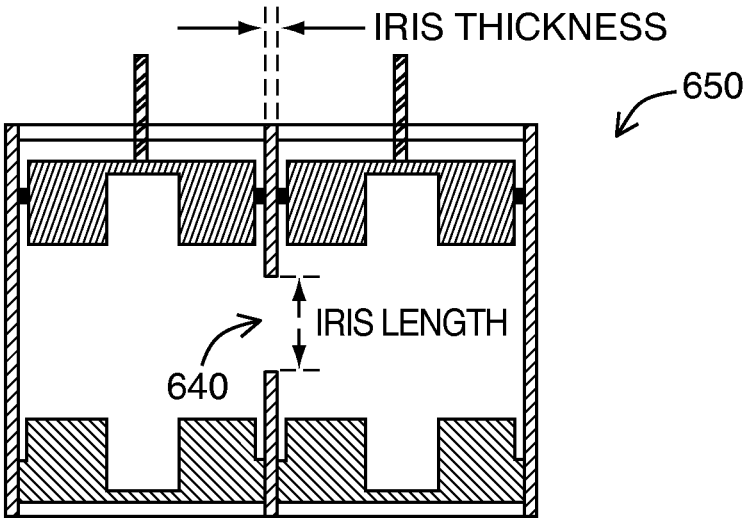
FIG. 6B is a side view schematic diagram of the two side-by-side resonators coupled together in FIG. 6A.

Reference is now made to FIG. 6A and FIG. 6B, which show a top view and side view schematic diagram respectively, of two side-by-side resonators coupled together in accordance with one embodiment. In particular, the schematic diagrams 600, 650 depict the naming convention for the dimensions of the iris 640 used for two side-by-side or adjacent resonators 610, 620. The length of the iris 640 (i.e., iris length) is parallel with a line describing the cavity length 220, as seen in FIG. 2. Furthermore, the iris width and iris thickness are orthogonal to the iris length and are furthermore orthogonal to each other. For completeness, the naming convention for the width and thickness are depicted in the schematics 600, 650 in FIG. 6A. For resonators 610, 620 arranged in single layer, the iris thickness is measured normal to the cavity wall joining the side-by-side resonators 610, 620. Accordingly, the iris width is orthogonal to both the iris length and the iris thickness and may be measured tangentially to the cylindrically shaped resonators 610, 620. As depicted in FIG. 6A, the iris 640 may be positioned at the narrowest location within the cavities joining the two resonators 610, 620.

The table in FIG. 6C details design and performance parameters for the coupled resonators 610, 620 in FIG. 6A and FIG. 6B operating with exemplary dimensions. As seen in FIG. 6C, the table may describe the measured performance when the resonators 610, 620 seen in FIG. 6A and FIG. 6B are coupled using either a short iris or a long iris. In particular, a short iris is described by an iris length that is shorter than half of the free space wavelength of the resonant frequency (i.e., ~0.295 inches for a resonator operating at ~20 GHz) and a long iris is described by an iris length that is longer than a half wavelength. It should be apparent the cavity lengths of the pair of adjacent resonators incorporating a long iris must also be greater than a half wavelength, but that other values are possible. The values depicted for any of the dimensions should not be construed as limiting.

As seen in FIG. 6C, the length of the iris 640 (i.e., iris length) is 0.200 inches in the first configuration 602 and 0.400 inches in the second configuration 604. The other dimensions are held constant across both configurations 602, 604 (i.e., the desired operating frequency, cavity diameter, cavity length, gap depth, and iris width). Accordingly, the only difference in variables may be the length of the iris 640, where the first configuration 602 describing a short iris has an iris length less than half the free space wavelength (i.e., ~0.295 inches) and the second configuration 604 describing a long iris has an iris length greater than half the free space wavelength.

With the iris length 0.200 inches in the first configuration 602, the odd mode frequency, as described above in relation to FIG. 5A and FIG. 5B, is 19.808 GHz. Similarly, the even mode frequency is 19.913 GHz. Accordingly, since the odd mode frequency is less than the even mode frequency, the coupling sign is negative (i.e., negative coupling) for the two adjacent resonators 610, 620.

With the iris length 0.400 inches in the second configuration 604, the odd mode frequency, as described above in relation to FIG. 5A and FIG. 5B, is 20.093 GHz. Similarly, the even mode frequency is 19.880 GHz. Accordingly, since the odd mode frequency is greater than the even mode frequency, the coupling sign is positive (i.e., positive coupling) for the two adjacent resonators 610, 620.

Long irises may provide a method for coupling two resonator cavities having a resonant frequency in a TE011 cavity filter assembly. The method includes providing two resonator cavities 610, 620. A long iris may then couple the two resonator cavities 610, 620. As an iris 640 is an aperture having a width, a thickness, and a length, the length of the long iris may be greater than half of the free space wavelength of the resonant frequency. A long iris may also be described as two coupled resonator cavities having two resonance modes where the odd mode frequency is greater than an even mode frequency.

The long iris may be described as providing positive coupling, wherein positive coupling includes a coupling sign that is opposite to a short iris. The short iris is an iris 640 (i.e. an aperture) having a width, a thickness, and a length, coupling the two resonator cavities, but where the length of the short iris is less than half of the free space wavelength of the resonant frequency.

Figure 6D:
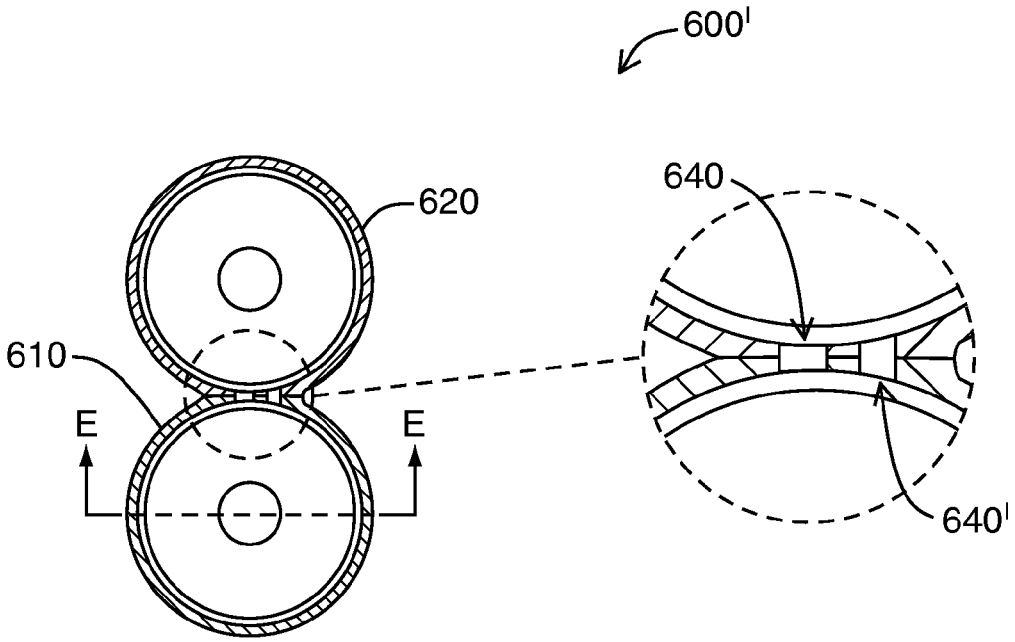
FIG. 6D is a top view schematic diagram of two side-by-side resonators coupled together in an alternative embodiment.
Figure 6E:
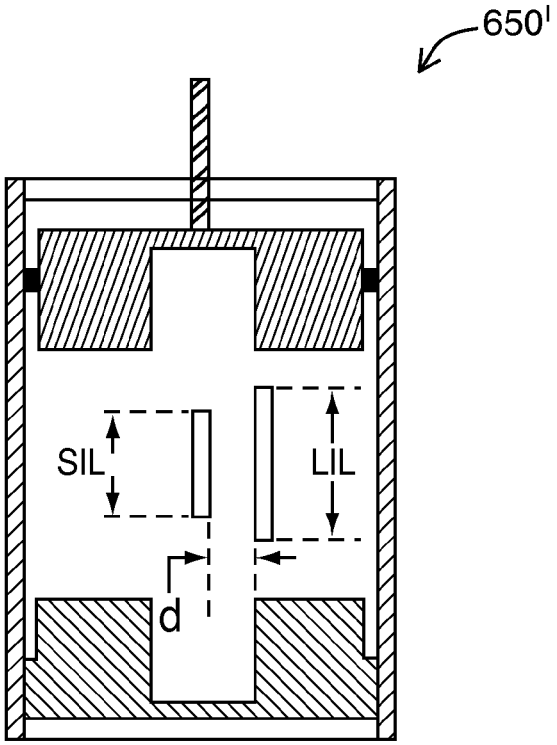
FIG. 6E is a side view schematic diagram of the two side-by-side resonators coupled together in FIG. 6D along the cut line E.

In some embodiments, both a long iris and a short iris may couple a pair of side-by-side resonators. Referring now to FIG. 6D and FIG. 6E, a top view 600' (FIG. 6D) and side view 650' (FIG. 6E) schematic diagram of two side-by-side resonators 610, 620 coupled together is depicted in an alternative embodiment. The side view schematic 650' of FIG. 6E is a cross-sectional view taken along section line E-E (FIG. 6D).

As illustrated in FIG. 6D, the two resonators 610, 620 may incorporate both a long iris 640' and a short iris 640 to couple the same two resonators 610, 620. As depicted in the side view schematic 650' of FIG. 6E, the short iris 640 and the long iris 640' may be centered lengthwise within the resonators 610, 620 and offset laterally by a distance d. In at least one embodiment, the short iris 640 may be centered at the narrowest location within the cavities joining the resonators 610, 620 and the long iris 640' may be offset from the center (and short iris 640) by a distance d, which may be approximately 0.1 inches. In other embodiments, the long iris 640' may be centered at the narrowest location or both irises 640, 640' may be off-center horizontally and/or vertically within the resonators 610, 620. Other configurations are also possible.

Figure 6F:
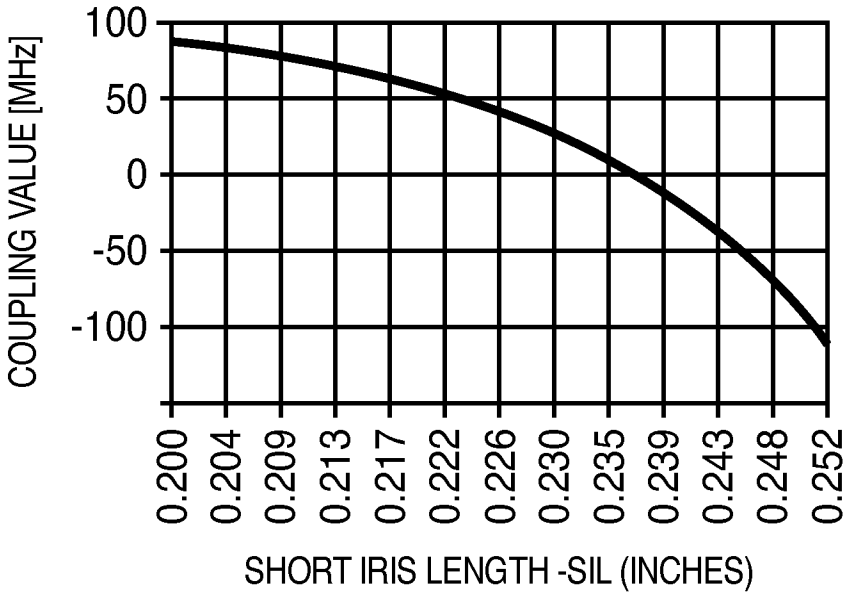
FIG. 6F is a graph depicting the coupling value of the resonators in FIG. 6D and FIG. 6E with respect to short iris length.

It has been discovered that the differential coupling as depicted in FIG. 6D and FIG. 6E, may provide a wide range of coupling values. For example, as depicted in FIG. 6E, the coupling value between two resonators 610, 620 can be adjusted by varying the short iris length (SIL) relative to the long iris length (LIL). This may provide a range of both positive and negative coupling values across a wide spectrum of magnitudes (including small coupling values). Referring to FIG. 6F, a graph is depicted for an embodiment as shown in FIG. 6D and FIG. 6E showing coupling value ("COUPLING VALUE [MHz]" on y-axis) for different lengths of the short iris length ("SHORT IRIS LENGTH-SIL (INCHES)" on x-axis) while holding the magnitudes of long iris length LIL (i.e., 0.40 inches), the long iris width (LIW) (i.e. 0.05 inches), and the short iris width (SIW) (i.e. 0.05 inches) constant as shown in the Table. As depicted in FIG. 6E, adjusting the short iris length SIL relative to the long iris length LIL may provide a ±100 MHz swing in the coupling value between the two resonators 610, 620. Accordingly, the coupling value between two resonators 610, 620 may be adjusted in both directions (both increased or decreased) after fabrication using such differential coupling.

Reference is now made to FIG. 7A, which shows a schematic diagram of two stacked resonators coupled together. The two resonators are stacked with no cavity offset. The two resonator cavities share a cavity end wall and the long iris may couple the two stacked resonator cavities through the common cavity end wall. The schematic diagrams 700 (FIG. 7A), 750 (FIG. 7B), depict the naming convention for the dimensions of the iris 740 used for two stacked resonators 710, 720. The length of the iris 740 (i.e., iris length) is measured axially in the same plane as the common end wall. Furthermore, the iris width and iris thickness are orthogonal to the iris length and are further orthogonal to each other. The naming convention for the width and thickness are depicted in the schematics 700, 750 in FIGS. 7A and 7B. The iris thickness (FIG. 7B) may be measured as the thickness of the common cavity end wall joining the stacked resonators 710, 720 (FIG. 7B). Accordingly, the iris width may lie in the same plane as the iris length and the common cavity end wall, where the iris width is orthogonal to the iris length (FIG. 7A).

The table in FIG. 7C details design and performance parameters for the coupled resonators 710, 720 in FIGS. 7A and 7B operating with exemplary dimensions. As seen in FIG. 7C, the table may describe the measured performance when the resonators 710, 720 seen in FIGS. 7A and 7B are coupled using either a short iris or a long iris. It should be apparent that other values are possible. The values depicted should not be construed as limiting.

As seen in FIG. 7C, the length of the iris 740 (i.e., iris length) is 0.240 inches in the first configuration 702 and 0.430 inches in the second configuration 704. The other dimensions are held constant across both configurations 702, 704 (i.e., the desired operating frequency, cavity diameter, cavity length, gap depth, and iris width). Accordingly, the only variable may be the length of the iris 740, where the first configuration 702 has an iris length less than half the free space wavelength (i.e., ~0.295 inches) and the second configuration 704 has an iris length greater than half the free space wavelength.

With the iris length 0.240 inches in the first configuration 702, the odd mode frequency, as described above in relation to FIG. 5A and FIG. 5B, is 19.858 GHz. Similarly, the even mode frequency is 19.981 GHz. Accordingly, since the odd mode frequency is less than the even mode frequency, the coupling sign is negative (i.e., negative coupling) for the two resonators 710, 720 with an iris length of 0.240 inches for the iris 740.

With the iris length 0.430 inches in the second configuration 704, the odd mode frequency, as described above in relation to FIG. 5A and FIG. 5B, is 20.163 GHz. Similarly, the even mode frequency is 19.973 GHz. Accordingly, since the odd mode frequency is greater than the even mode frequency, the coupling sign is positive (i.e., positive coupling) for the two resonators 710, 720 with an iris length of 0.430 inches for the iris 740.

Figure 7D:
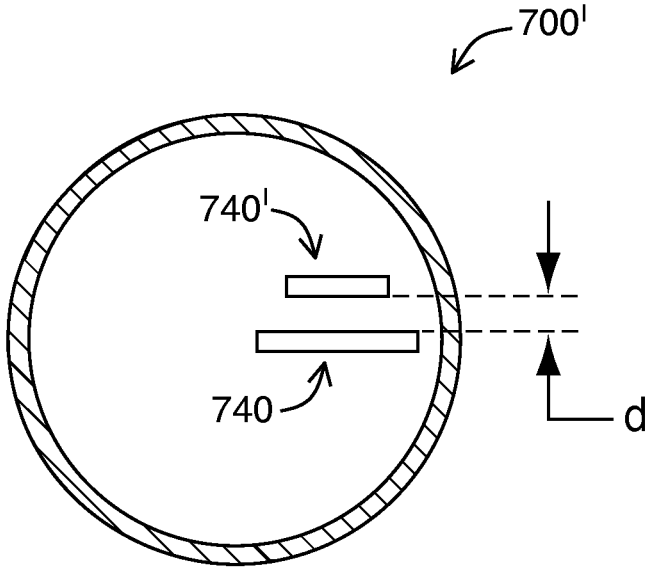
FIG. 7D is a top view schematic diagram of two stacked resonators coupled together with no cavity offset in an alternative embodiment.
Figure 7E:
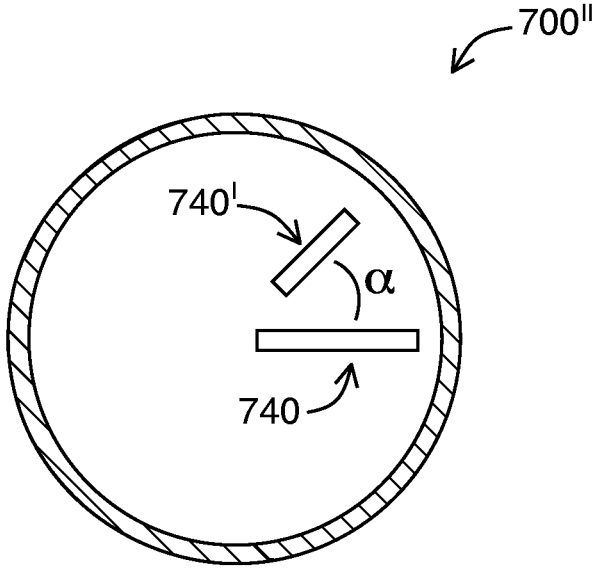
FIG. 7E is a top view schematic diagram of two stacked resonators coupled together with no cavity offset in another alternative embodiment.

Referring now to FIG. 7D and FIG. 7E, differential coupling incorporating both a short iris 740' and long iris 740 may be used with stacked resonators 710, 720. As with the side-by-side resonator configuration seen in FIG. 6D and FIG. 6E, in some embodiments, both a long iris and a short iris may couple the same pair of stacked resonators 710, 720 as shown in FIG. 7B.

The top view schematic 700' seen in FIG. 7D depicts a short iris 740' offset from a long iris 740 laterally by a distance d. In some embodiments, the long iris 740 is centered radially within the resonators while the short iris 740' is offset. In other embodiments, the short iris 740' may be centered radially and the long iris 740 is offset or both irises 740, 740' may be offset from center.

In another embodiment as seen in the top view schematic 700" seen in FIG. 7E, both the long iris 740 and the short iris 740' are centered radially and offset by an angle $\alpha$. As discussed with regards to FIG. 6F, differential coupling may provide for the fine adjustment of the coupling value between two stacked resonators.

Figure 8A:
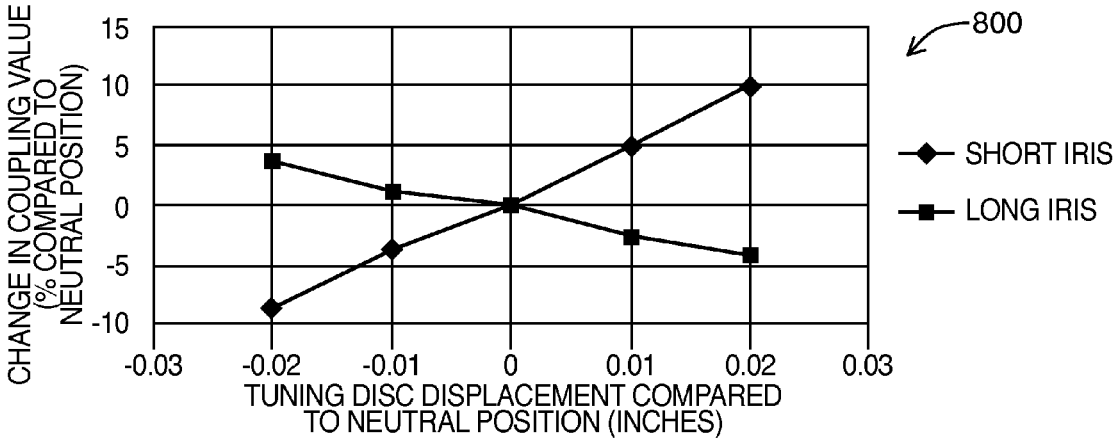
FIG. 8A is a graph depicting the tuning performance of a pair of coupled resonators with respect to cavity length variation using a long iris and a short iris.
Figure 8B:
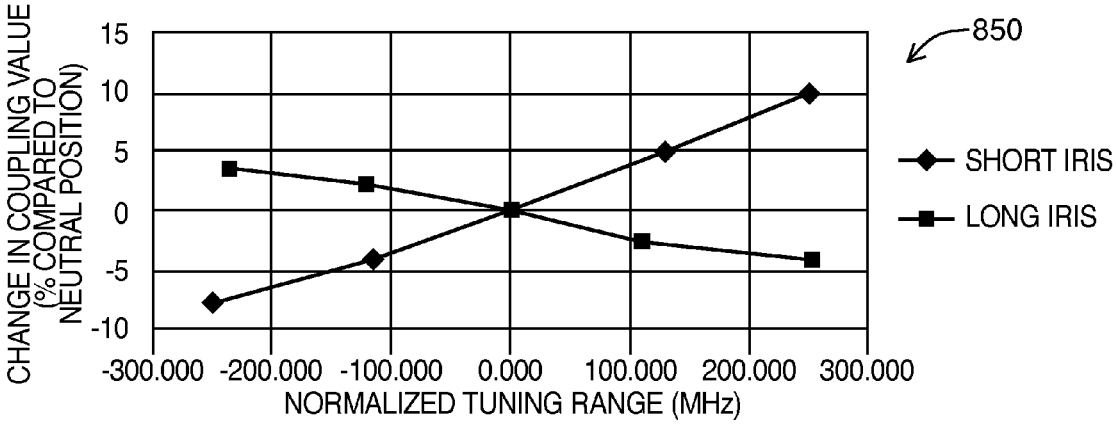
FIG. 8B is a graph depicting the tuning performance of the pair of coupled resonators with respect to frequency variation using a long iris and a short iris.

Reference is now made to FIG. 8A and FIG. 8B, which respectively show graphs 800 (FIG. 8A), 850 (FIG. 8B) illustrating the measured change in coupling performance using a long iris and a short iris, The graph 800 measures the variation in coupling value (shown as "CHANGE IN COUPLING VALUE (% COMPARED TO NEUTRAL POSITION)" on y-axis) with respect to changing tuning disc displacement (shown as "TUNING DISC DISPLACEMENT COM- PARED TO NEUTRAL POSITION (INCHES)" on x-axis) in FIG. 8A. The graph 850 measures variation in coupling value (shown as "CHANGE IN COUPLING VALUE (% COMPARED TO NEUTRAL POSITION)" on y-axis) with respect to varying resonant frequency (shown as "NORMALIZED TUNING RANGE (MHz)" on x-axis) in FIG. 8B. The graphs 800, 850 may illustrate the performance of two side-by-side resonators in a configuration similar to the configuration depicted in FIG. 6A at a desired resonant frequency of approximately 20 GHz. It should be apparent that other dimensions are possible; therefore, the measured values for the differences in coupling variation for a long iris and a short iris should only be held as illustrative and not be construed as limiting.

The side-by-side resonators (not shown) may include two metal discs positioned within each resonator. Furthermore, a metal disc in each of the side-by-side resonators may be fixed inside the cavity as seen in FIG. 6A and explained in relation to FIG. 2. The other metal disc in each resonator may be used to tune each side-by-side resonator using a tuning mechanism, as described in FIG. 2. The tuning mechanism may operate by changing the cavity length of each resonator, as previously explained. The tuning mechanisms for each of the side-by-side resonators may be coupled such that a single actuator may be used to control the displacement or tuning frequency for both resonators.

Referring now to FIG. 8A, the graph 800 illustrates the variation in coupling value (y-axis) for both a long iris and short iris with respect to tuning disc displacement (x-axis) compared to a desired cavity length. As seen in the graph 800 of FIG. 8A, the long iris shows reduced coupling value variation in comparison to a short iris across the same displacement range. For a tuning disc displacement of −0.02 inches, the long iris has a measured coupling value change of approximately four percent (+4%), while the short iris has a measured coupling value change of approximately negative nine percent (−9%). Similarly, at a displacement of 0.02 inches, the long iris has a measured coupling value change of approximately negative 4 percent (−4%), while the short iris has a measured coupling value change of approximately ten percent (+10%). Such a graph shows that the signs of coupling between a short iris and a long iris are opposite (i.e., where one iris has negative coupling and the other iris has positive coupling). Furthermore, the long iris demonstrates less variation in coupling value with respect to cavity length variation in comparison with the short iris.

The graph 850 of FIG. 8B shows a similar insensitivity to tuning frequency variation. For a 500 MHz swing, the use of a long iris displays a coupling variation of approximately ±4% whereas the same swing using a short iris displays a coupling variation of almost ±9%. It is also apparent that the graph 850 of FIG. 8B shows the same coupling polarization, where for any given cavity length, one iris will demonstrate positive coupling and the other iris will demonstrate negative coupling.

Accordingly, the graphs 800, 850 of FIG. 8A and FIG. 8B demonstrate that long irises (i.e., irises with lengths over half of the free space wavelength of the desired resonant frequency) exhibit a lower sensitivity to cavity length variation (and hence resonant frequency variation). This feature may allow long irises to be included in many applications where stable coupling over a wide range of cavity length variation is desired, such as tunable filters. Tunable filters with very stable responses can then be designed by incorporating long irises. Furthermore, low cavity length sensitivity may make long irises attractive to microwave filter designers since it may reduce fabrication complexity and increase the fabrication tolerances. Fixed TE011 cavity filter assembly designs may be manufactured using tunable filters incorporating long irises and may be tuned and set according to design parameters subsequent to manufacturing.

Figure 9A:
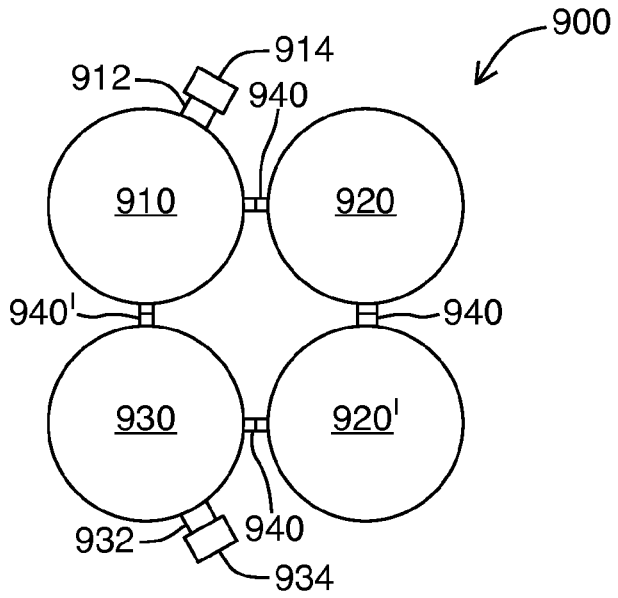
FIG. 9A is a schematic top view diagram of a four pole TE011 cavity filter assembly in accordance with at least one embodiment.

Reference is now made to FIG. 9A, which shows a TE011 cavity filter assembly 900 implementing a four-pole elliptical filter function according to one embodiment. In alternative embodiments, the TE011 cavity filter assembly 900 may have any number of poles by including an appropriate number of resonators. In the example seen in FIG. 9A, the TE011 cavity filter assembly 900 includes four resonators 910, 920, 920', 930 positioned as a single-layer. The TE011 cavity filter assembly 900 may include an input resonator 910 connected to an input iris 912. It may also include an output resonator 930 connected to an output iris 932. The input iris 912 and the output iris 932 may be connected to external ports, such as input port 914 and output port 934, respectively. For example, the external ports 914, 934 may include waveguides, coaxial cables, and the like. Furthermore, additional resonators 930, 930' may be included to increase the number of poles and thereby improve the transmission response of the corresponding filter function.

The TE011 cavity filter assembly 900 may also include at least one resonator 910, 920, 920', 930 having a metal disc (not shown). The metal disc may include a gap and a void as seen in the exemplary resonator 200 described in FIG. 2. Furthermore, a resonator 910, 920, 920', 930 may include two metal discs positioned at either end of the resonator cavity. One of the metal discs may be fixed to the end wall of the cavity, In some embodiments, one or more of the resonators 910, 920, 920', 930 may be tunable using a tuning mechanism described above in FIG. 2. If more than one resonator 910, 920, 920', 930 of the TE011 cavity filter assembly 900 is tunable, one or more of the tuning mechanisms 270 (FIG. 2) for each resonator 910, 920, 920', 930 may be mechanically coupled together. This may allow a single tuning mechanism (not shown) to adjust the position of the metal disc for more than one of the tunable resonators 910, 920, 920', 930. As described in FIG. 2, this may involve moving the first metal disc 230 in each of the resonators 910, 920, 920', 930 by the same fixed amount within the cavity 202.

As described above, irises 940 may be used to electrically connect the four resonators 910, 920, 920', 930, coupling the resonators 910, 920, 920', 930 to each other. In addition, the irises 940 may include both long irises and short irises. Use of both long irises and short irises allows the TE011 cavity filter assembly 900 to be designed as a single-layer.

It is known in the art that coupling two irises 940 to a resonator 910, 920, 920', 930 at 90 degrees suppresses the degenerate TM111 mode. 90 degree coupling is used widely where cross coupling is not incorporated into the cavity filter design. However, it has been found that if cross coupling is desired, there cannot be two 90 degree angles between the three irises because it would excite both the TM111 mode and the TE311 mode, causing unwanted coupling that may degrade the filter performance. Accordingly, if a TE011 cavity filter assembly 900 is designed with cross coupling, only two irises will be positioned at 90 degrees to one another. The geometry of the third iris, or additional iris, will be considered with the additional iris connected to the resonator at an angle to suppress unwanted TM111 mode and TE311 mode coupling.

For example, for the three irises 912, 940, 940' connected to the resonator 910 connected to the input iris 912, the angle between the input iris 912 and the iris 940 connecting to the next sequential resonator 920 is 60 degrees. Furthermore, the angle between the same iris 940 and the iris 940' cross coupling the input resonator 910 with the output resonator 930 is 90 degrees. In this manner, the combination of the 60 degree angle and the 90 degree angle does not cause unwanted degradation of the filter performance. A similar configuration is seen with the three irises 932, 940, 940' connected to the output resonator 930. The angle between the output iris 932 and the sequential iris 940 is 60 degrees, with the angle between the sequential iris 940 and the cross coupling iris 940', 90 degrees. Although the geometry of the cross coupling seen in FIG. 9A uses the combination of a 90 degree angle and a 60 degree angle, it should be appreciated that other angles are possible using long irises 940 to implement cross coupling in a single layer.

For the exemplary filter 900 seen in FIG. 9A, the TE011 cavity filter assembly 900 includes three long irises 940 implementing positive coupling and one short iris 940' implementing negative coupling. The three long irises 940 may be used for sequential coupling (i.e., 910 and 920, 920 and 920', 920' and 930). The short iris 940' may be used for cross coupling the input resonator 910 and the output resonator 930 as described above. If only short irises were utilized, the design of the TE011 cavity filter assembly 900 would require two of the resonators 920, 920' to be stacked (i.e., as two-layers) in order to implement positive coupling using known techniques (not shown).

In some embodiments to create any type of filter function, long irises 940 may also be used to connect two stacked cavities 750 as described in FIG. 7A and FIG. 7B. As described in relation to FIG. 7A, if long irises 940 are used with stacked cavities 750, the long iris 740 may connect the stacked cavities through the common end wall, with no cavity offset required. A TE011 cavity filter assembly 900 utilizing stacked cavities may incorporate the stable performance of the long irises 940 with a compact size afforded by stacking the cavities without an offset.

Figure 9B:
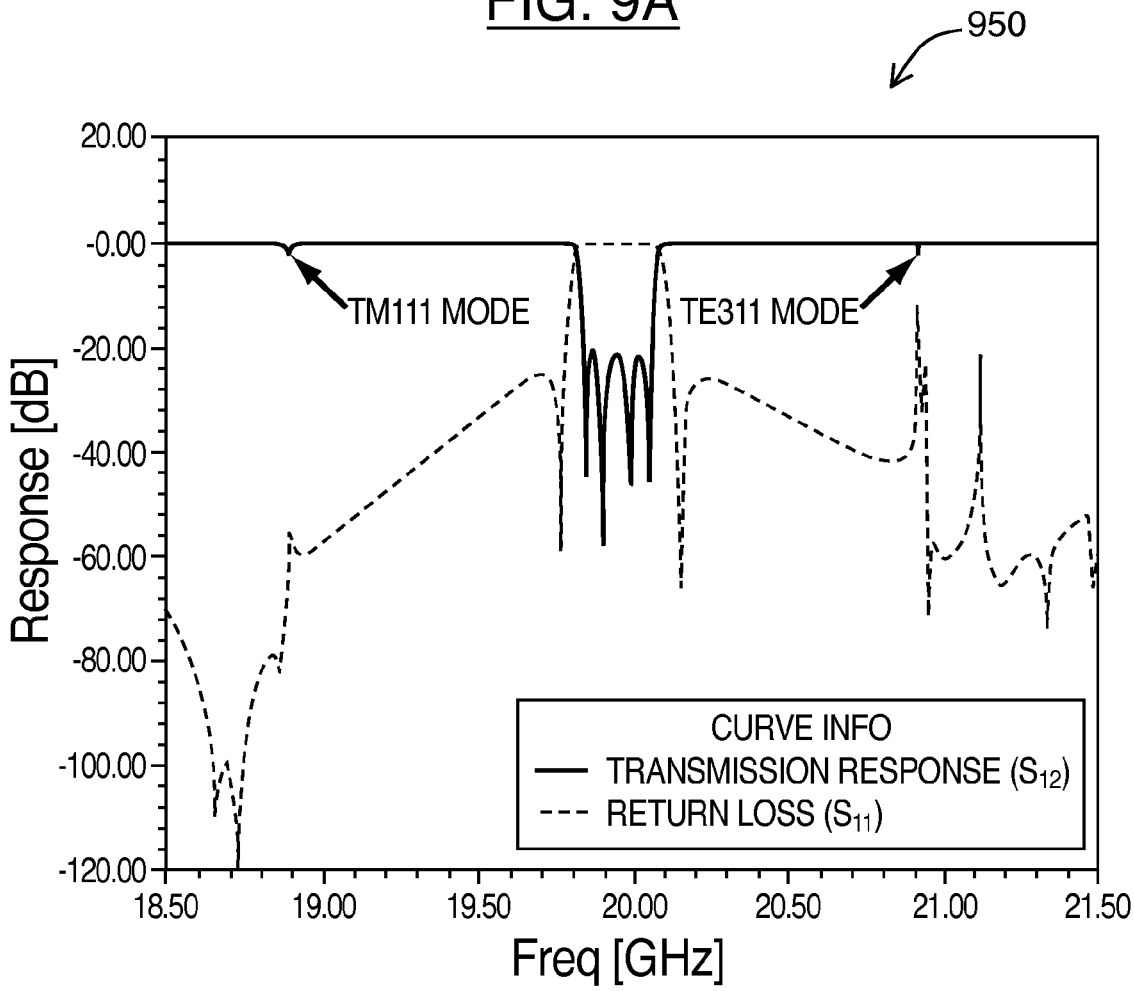
FIG. 9B is a graphical representation of the performance of the four pole TE011 cavity filter assembly seen in FIG. 9A.

FIG. 9B shows the simulated response in dB (transmission response ($S_{12}$) and return loss ($S_{11}$)) of the TE011 cavity filter assembly 900 vs. frequency in GHz, as shown in FIG. 9A. The resonators 910, 920, 920', 930 may include two metal discs in each resonator cavity. As can be seen in the graph 950, the TE011 cavity filter assembly 900 exhibits a transmission response with a 2 GHz spurious-free window centered on the resonant frequency of the operating TE011 mode (i.e., 20 GHz). The resonant frequency of the degenerate TM111 mode(s) at 19 GHz has been split from the operating TE011 mode and shifted to lower frequencies. Similarly, the spurious TE311 mode remains at 21 GHz providing a wide frequency band of stable operation. The insertion loss is low, allowing for high-power applications. Furthermore, the filter notch exhibits a sharp cut-off response at one or both passband edges.

The use of a long iris can be used to improve the TE011 filter design for both functionality and layout. Single layers and in-line stacked layouts are the most important examples that benefit from the long iris. A tunable filter is another application that benefits from the long iris' low longitudinal sensitivity characteristic with the beneficial response described with regards to FIG. 8A and FIG. 8B.

Figure 10A:
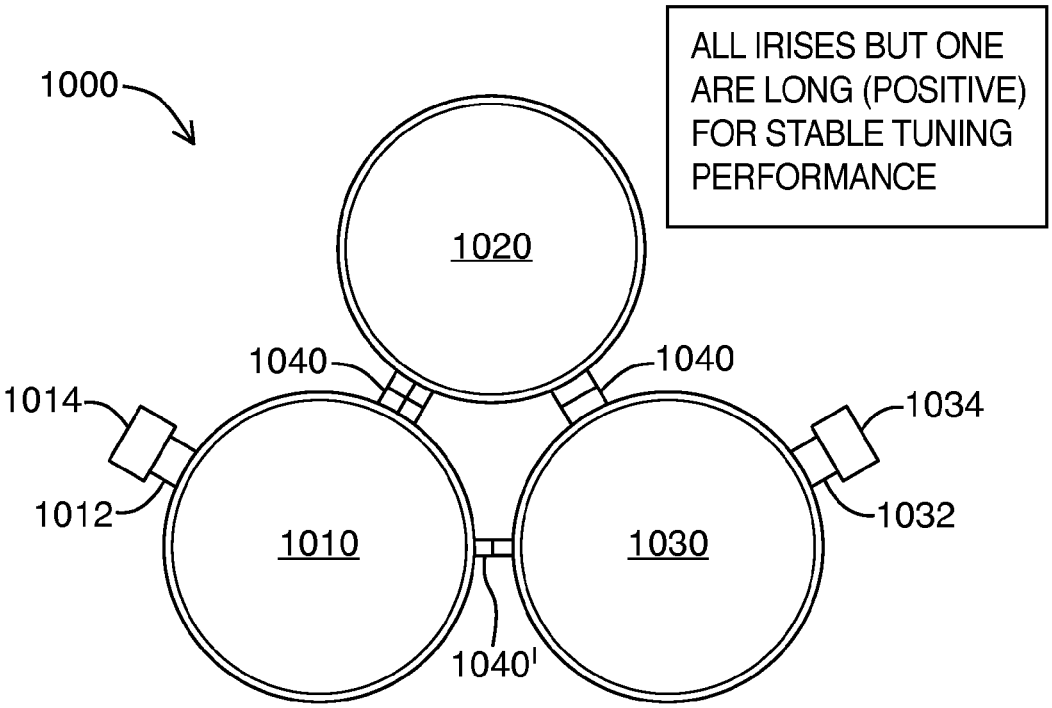
FIG. 10A is a schematic top view diagram of a single layer tri-section operating as a high pass filter in accordance with another embodiment.
Figure 10B:
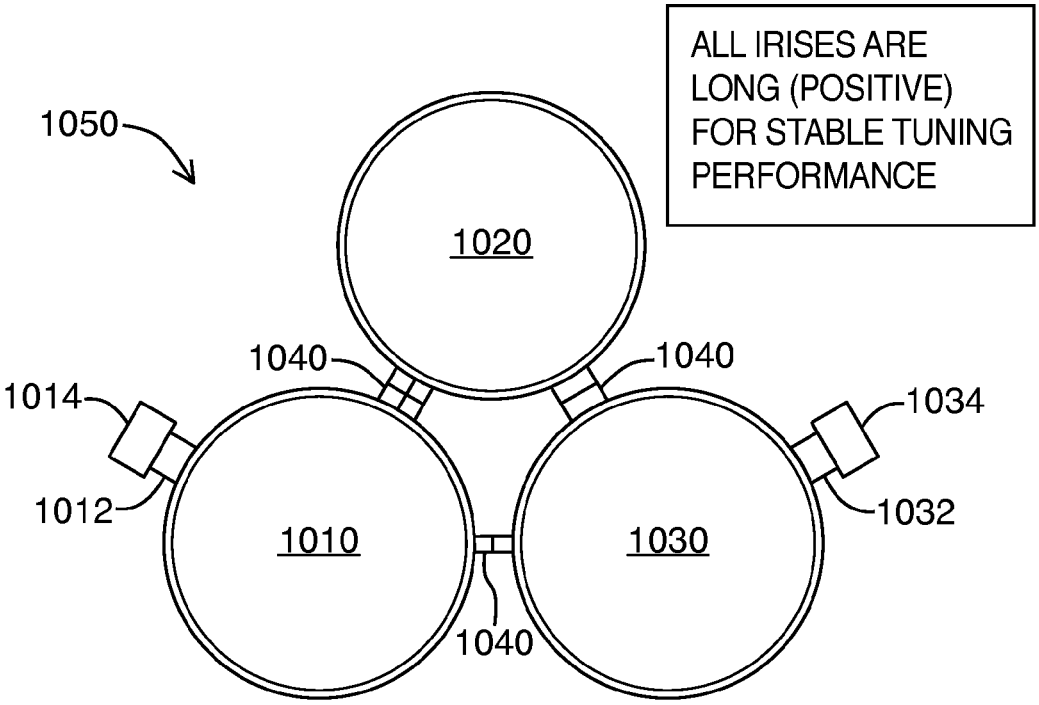
FIG. 10B is a schematic top view diagram of a single layer tri-section operating as a low pass filter in accordance with another embodiment.

Reference is now made to FIG. 10A, which shows a pseudo high pass tunable filter 1000 and FIG. 10B, which shows a pseudo low pass tunable filter 1050 according to some embodiments. As seen in FIG. 10A and FIG. 10B, the two filters 1000, 1050 may be designed using the same general single layer tri-section configuration. The two single layer tri-sections 1000, 1050 may include three resonators 1010, 1020, 1030. Each of the resonators 1010, 1020, 1030 may include a first metal disc 230 and/or a second metal disc 250 as described and depicted in FIG. 2. The single layer tri-sections 1000, 1050 may include an input iris 1012 coupled to an input resonator 1010 and an output iris 1032 coupled to an output resonator 1030. The input iris 1012 may further connect to an input port 1014, which may include a waveguide, a coaxial cable, and the like. Similarly, the output iris 1032 may further connect to an output port 1034, which may also include a waveguide, a coaxial cable, and the like. The single layer tri-section 1000, 1050 may also include irises 1040, 1040' for coupling the resonators 1010, 1020, 1030 together.

In FIG. 10A, the pseudo high pass tunable filter 1000 includes two long irises 1040 and one short iris 1040' for coupling the three resonators 1010, 1020, 1030 together. Accordingly, all irises of the pseudo high pass tunable filter 1000 are long (positive) except for one for stable tuning performance. The two long irises 1040 couple the three resonators 1010, 1020, 1030 sequentially (i.e., 1010 and 1020, 1020 and 1030). Furthermore, a short iris 1040' is used to cross couple the input resonator 1010 and the output resonator 1030. The mixed use of long and short irises allows the pseudo high pass tunable filter 1000 to be designed in a single layer. Further, the cross coupling utilizes the cross coupling techniques described above with respect to the geometry of the cross coupling irises. As depicted in FIG. 9A, the geometry of the irises 1040, 1012 connected to the input resonator 1010 and the irises 1040, 1032 connected to the output resonator 1030 may use the same combination of 90 degree and 60 degree angles and/or other geometrical configurations to suppress the degenerate TM111 mode(s) and unwanted TE311 mode.

In FIG. 10B, the pseudo low pass tunable filter 1050 includes three long irises 1040 for coupling the three resonators 1010, 1020, 1030. Accordingly, all irises of the pseudo low pass tunable filter 1050 are long (positive) for stable tuning performance. Two long irises 1040 couple the three resonators 1010, 1020, 1030 sequentially (i.e., 1010 and 1020, 1020 and 1030). Furthermore, a long iris 1040 is also used to cross couple the input resonator 1010 to the output resonator 1030, in contrast to the pseudo high pass filter 1000 in FIG. 10A. The pseudo low pass tunable filter 1050 may use the same cross coupling techniques described above with regards to FIG. 9A and FIG. 10A to implement cross coupling into the design of the pseudo low pass tunable filter 1050 while suppressing undesirable resonant modes.

A TE011 cavity filter assembly may include many single layer tri-sections 1000, 1050 coupled together. Each single layer tri-section adds one transmission zero to the response of the TE011 cavity filter assembly. As understood by persons skilled in the art, a pseudo low pass filter adds a transmission zero to the high side of the transmission response. Accordingly, a pseudo high pass filter adds a transmission zero the low side of the transmission response.

Figure 11A:
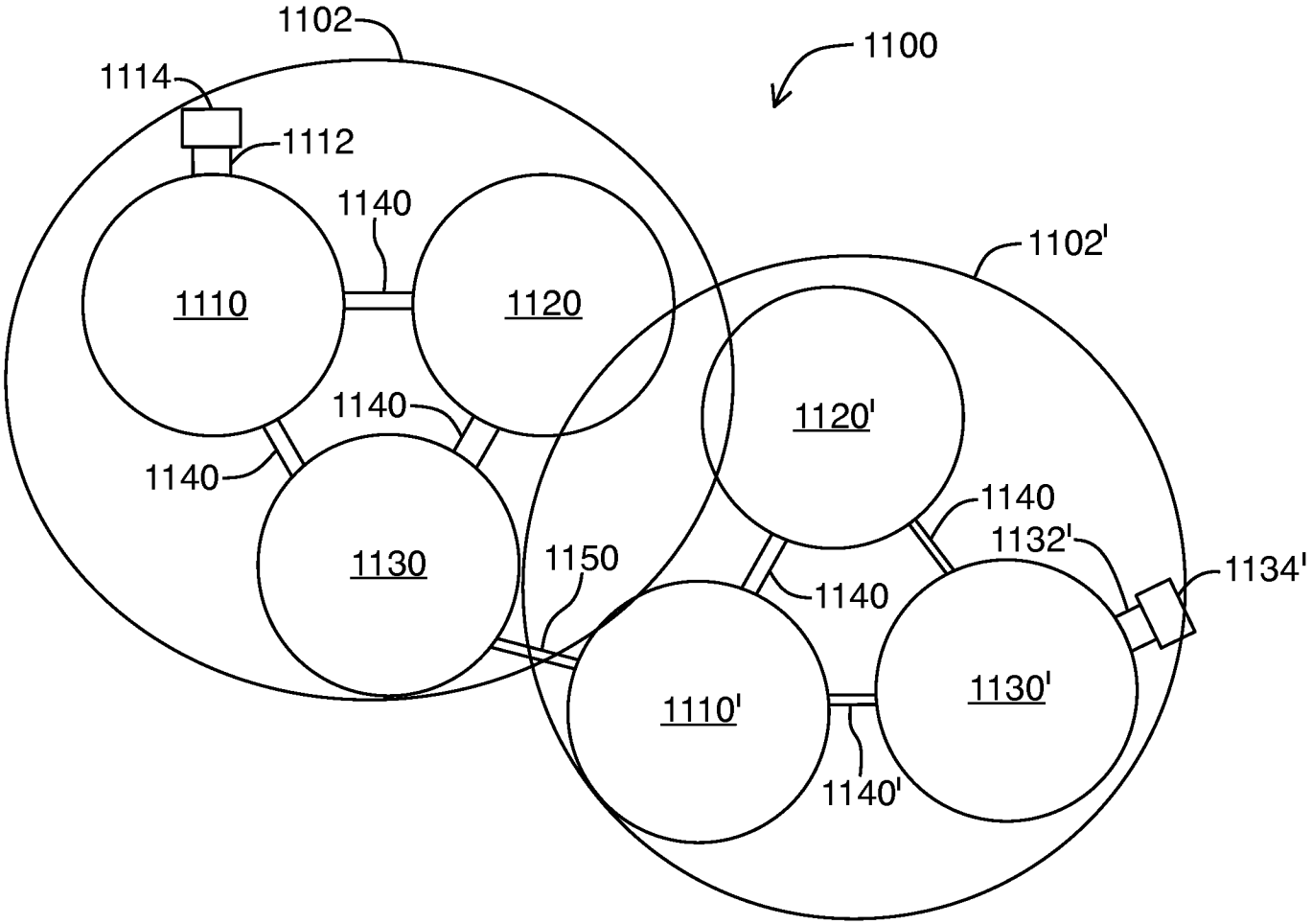
FIG. 11A is a schematic top view diagram of a TE011 cavity filter assembly comprising two coupled single layer tri-sections as may be illustrated in FIG. 10A and FIG. 10B in accordance with another embodiment.

Reference is now made to FIG. 11A, which shows a TE011 cavity filter assembly 1100 using two single layer tri-sections 1102, 1102' according to some embodiments. Each single layer tri-section 1102, 1102' may be constructed as a pseudo high pass filter 1000 or a pseudo low pass filter 1050 as described in FIG. 10A and FIG. 10B. As such, the TE011 cavity filter assembly may include an input iris 1112, an input port 1114, and output iris 1132' and an output port 1134'. The single layer tri-sections 1102, 1102' may be coupled together to make higher order filter functions. It should be apparent that additional single layer tri-sections 1102, 1102' may be added to the TE011 cavity filter assembly 1100 to create the desired transmission response.

An iris 1150 further connects the single layer tri-sections 1102, 1102' together. The iris 1150 may be a short iris or a long iris depending on the desired filter function for the TE011 cavity filter assembly 1100. It should be understood that any number of single layer tri-sections 1102, 1102' could be added to the TE011 cavity filter assembly 1100 to create complex and higher order filter functions (i.e. frequency responses).

As in FIG. 10A and FIG. 10B, each single layer tri-section 1102, 1102' in the TE011 cavity filter assembly 1100 includes three resonators 1110, 1120, 1130. Similarly, long irises may be incorporated as necessary to place the transmission zero of the single layer tri-section 1102, 1102' according to the desired frequency response. Long irises allow for flexible TE011 cavity filter assembly configurations while maintaining the single layer configuration. A benefit of the single layer configuration is that a single tuning mechanism 270, as described in FIG. 2 can be used to tune all three resonators 1110, 1120, 1130 simultaneously.

In some embodiments, the tuning mechanism for each of the three resonators 1110, 1120, 1130 may be coupled together such that a single actuator may tune each of the single layer tri-sections 1102, 1102' separately. Alternatively, a single actuator may be operable to tune the entire TE011 cavity filter assembly 1100 simultaneously. In such embodiments, uniform disc displacement using a single actuator may be enabled using resonators of varying cavity diameters. Different cavity diameters for the different resonators may enable the TE011 cavity filter assembly 1100 to be designed initially with a desired frequency or transmission response. Furthermore, the diameter for each resonator 1110, 1120, 1130 may be designed in order to maintain the same tuning slope for each resonator 1110, 1120, 1130 when the filter is in its neutral (e.g. as designed or manufactured) position.

In other embodiments, one or more of the resonators 1110, 1120, 1130 in the TE011 cavity filter assembly 1100, may be individually tuned as described above in FIG. 2. The ability to tune one or more resonators 1110, 1120, 1130 individually may allow the TE011 cavity filter assembly 1100 to be manufactured initially with relaxed tolerances and then be tuned subsequent to assembly. Such a process may reduce costs and manufacturing complexity.

Figure 11B:
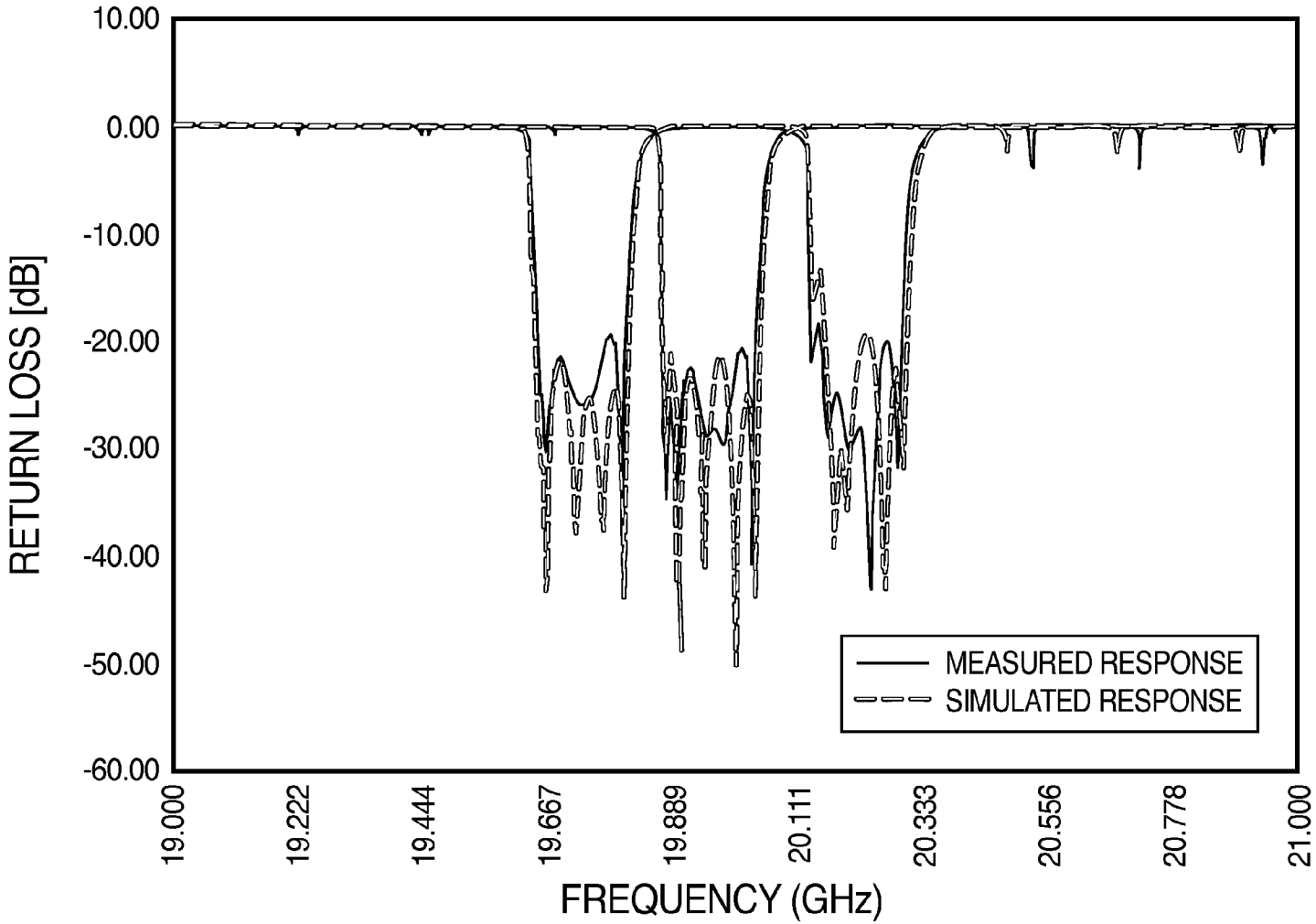
FIG. 11B is a graph depicting the simulated and measured return loss of the TE011 cavity filter assembly in FIG. 11A.
Figure 11C:
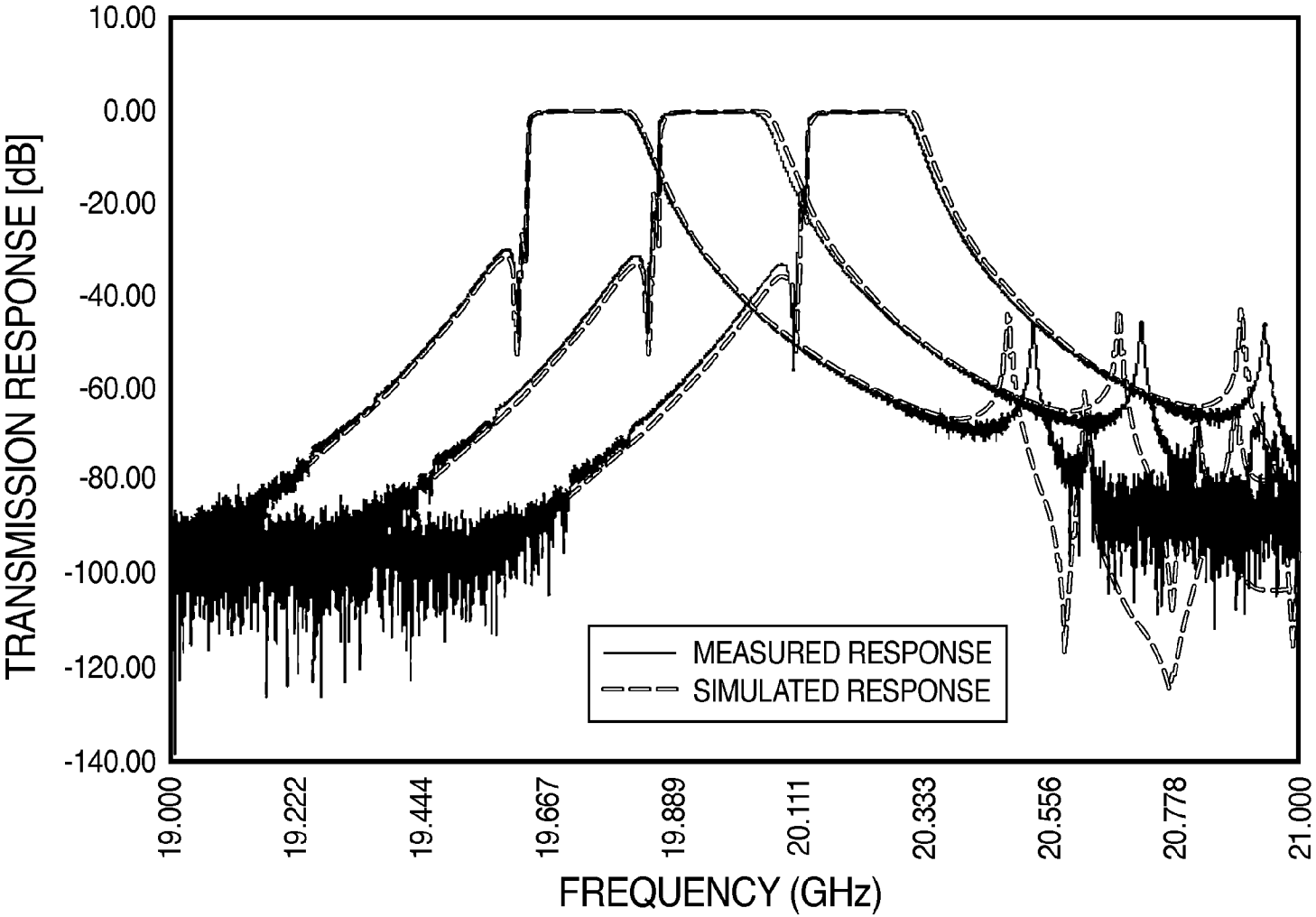
FIG. 11C is a graph depicting the simulated and measured transmission response of the TE011 cavity filter assembly in FIG. 11A.

Reference is now made to FIG. 11B and FIG. 11C, which depict the simulated and measured return loss (y-axis IN Db) and transmission response of the tunable TE011 cavity filter assembly in FIG. 11A taken at three different passbands. In both FIG. 11B and FIG. 11C, the simulated responses are represented by the dotted line and the measured responses are represented by the solid line. The overall spurious-free window (i.e., the frequency space between the degenerate TM111 and spurious TE311 modes when the filter is tuned at the high end and low end of the running range, respectively) is measured at 825 MHz versus the simulated window of 1 GHz.

Referring now to FIG, 11B, the graph depicts the return losses (y-axis in dB) for the tunable TE011 cavity filter assembly in FIG. 11A over 500 MHz of frequency tuning range (x-axis in GHz). As expected, the filter maintains a return loss of better than 17.5 dB with less than 4.5 dB out of band and 1.5 dB near band variation in notch levels over the measured tuning range. The three pairs of measured and simulated responses are in close agreement considering fabrication tolerances and tuning screw penetration to compensate for these tolerances.

Reference is now made to FIG. 11C, which depicts three transmission responses (y-axis in Db) for the tunable TE011 cavity filter assembly in FIG. 11A over 500 MHz of frequency tuning range (x-axis in GHz). The measured 3 dB bandwidth is better than 186 MHz over the entire tuning range and experiences less than 2% (±3 MHz) change with regard to the average value of 189 MHz. Measured absolute insertion loss is better than 0.38 dB over the entire tuning range compared to the simulation value of 0.18 dB.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claim is:

1. A resonator operating in TE011 mode having a resonant frequency and a TM111mode, said resonator comprising:

a cavity comprising an inner diameter, and a cavity length; and a first metal disc inside the cavity, the fist metal disc comprising a disc diameter and a void in the metal disc comprising a void diameter and a void depth;

wherein the inner diameter of the cavity is greater than the disc diameter creating a gap with a gap width and a gap depth; and wherein the void diameter and void depth of the void splits the TM111 mode from the operating TE011 mode and shifts the TM111 mode to a lower frequency than the TE011 mode resonant frequency.

2. The resonator of claim 1, wherein the resonator has a TE311 mode and wherein the gap width and the gap depth of the gap shifts a resonant frequency of the TE311 mode.

3. The resonator of claim 2, wherein the void diameter, void depth, gap width, and gap depth are selected to provide a wide spurious-free window centered about the resonant frequency of the operating TE011 mode.

4. The TE011 cavity filter assembly comprising at least one resonator of claim 1, wherein the at least one resonator is tunable, the TE011 cavity filter assembly further comprising:

a tuning mechanism to adjust the cavity length of the at least one resonator; and an enclosure contact to maintain electrical contact between the cavity of the at least one resonator and the first metal disc inside the cavity of the at least one resonator.

5. The TE011 cavity filter assembly of claim 4 further comprising a plurality of the at least one resonator operating in TE011 mode;

wherein the inner diameters of the plurality of resonators are non-uniform, and wherein the tuning mechanism further adjusts the cavity length of each of the plurality of resonators.

6. The TE011 cavity filter assembly of claim 4, wherein the enclosure contact defines a gap bottom and a gap depth, the gap depth being constant when the cavity length is adjusted.

7. The TE011 cavity filter assembly comprising at least one resonator of claim 1, further comprising:

a second metal disc inside the cavity of the at least one resonator at an end of the cavity opposite the first metal disc, the second metal disc comprising a second disc diameter and a second void in the second metal disc comprising a second void diameter and a second void depth;

wherein the inner diameter of the cavity of the at least one resonator is greater than the second disc diameter creating a second gap with a second gap width and a second gap depth.

8. The TE011 cavity filter assembly of claim 7, wherein the at least one resonator comprises at least two resonators, the cavity filter assembly further comprising:

at least one iris for coupling the least two resonator, wherein the at least one iris comprises an aperture having a width, a thickness, and a length coupling the at least two resonators.

9. The TE011 cavity filter assembly of claim 8, wherein the at least one iris is a long iris, wherein the length of the long iris is greater than half of the free space wavelength of the resonant frequency, and wherein the cavity lengths of the at least two resonators are greater than the length of the long iris.

10. The TE011 cavity filter assembly of claim 9, the TE011 cavity filter assembly further comprising:

at least one short iris, wherein the length of the at least one short iris is less than half of the free space wavelength corresponding to the resonant frequency.

11. The TE011 cavity filter assembly of claim 10, wherein the at least one long iris and the at least one short iris couple the same ones of the at least two resonators.

12. The TE011 cavity filter assembly of claim 8, wherein the at least two cavities are stacked with no cavity offset and share a common cavity end wall.

13. The TE011 cavity filter assembly of claim 8, further comprising:

cross coupling the at least one resonator operating in TE011 mode, wherein the cross coupling comprises at least three irises connecting to the one resonator, wherein the one resonator has a TM111 mode and a TE311 mode, and wherein the geometry of the at least three irises connecting to the one resonator suppresses the TM111 mode and the TE311 mode.

14. The TE011 cavity filter assembly of claim 13, further comprising:

an input iris and an output iris, wherein at least one of the three cross coupling irises connecting to the one resonator comprises either the input iris or the output iris and connects to an outside waveguide line.

15. The TE011 cavity filter assembly of claim 13, further comprising:

at least one single layer tri-section, wherein the at least one single layer tri-section comprises three of the at least one resonator in a single layer.

16. The TE011 cavity filter assembly of claim 15, wherein at least one of the at least one single layer tri-section is tunable, the TE011 cavity filter assembly further comprising:

a tuning mechanism to adjust the cavity length of the three resonators of the at least one single layer tri-section.

17. The TE011 cavity filter assembly of claim 15, wherein each single layer tri-section adds one transmission zero to high frequency side of the passband.

18. The TE011 cavity filter assembly of claim 15, wherein the TE011 cavity filter assembly comprises a plurality of coupled single layer tri-sections.

19. The TE011 cavity filter assembly of claim 7, wherein at least one of the first metal disc and the second metal disc inside the cavity of the at least one resonator is fixed to the inside of the cavity.

20. The resonator of claim 1, wherein the gap depth of the gap is less than a quarter of a free space wavelength corresponding to the resonant frequency.

21. A method for coupling two resonators having a resonant frequency in a TE011 cavity filter assembly, the method comprising:

providing two resonators according to claim 1; and coupling the two resonators using a long iris, wherein the long iris is an aperture having a width, a thickness, and a length, wherein the length of the long iris is greater than half of the free space wavelength corresponding to the resonant frequency;

wherein the two coupled resonators comprise two resonance modes having an odd mode frequency greater than an even mode frequency;

wherein the long iris provides positive coupling;

wherein positive coupling comprises a coupling sign that is opposite to a short iris; and wherein the short iris is an aperture having a width, a thickness, and a length, coupling the two resonators, wherein the length of the short iris is less than half of the free space wavelength of the resonant frequency.

22. The method for coupling the two resonators of claim 21, wherein the two resonators comprise two adjacent resonators.

23. The method for coupling the two resonators of claim 21, wherein the two resonators comprise stacked resonators having no cavity offset and share a common cavity end wall, and wherein the long iris couples the two stacked resonators through the common cavity end wall.

24. The method for coupling the two resonators of claim 21, wherein the long iris provides low sensitivity to cavity length variation.

25. The method for coupling the two resonator cavities of claim 21, further comprising:

coupling the two resonators using a short iris, wherein the short iris is an aperture having a width, a thickness, and a length, coupling the two resonators, and wherein the length of the short iris is less than half of the free space wavelength of the resonant frequency, wherein the two coupled resonators comprise two resonance modes having an odd mode frequency less than an even mode frequency.

* * * * *